US010221789B2

(12) United States Patent
Nakagawa et al.

(10) Patent No.: US 10,221,789 B2
(45) Date of Patent: Mar. 5, 2019

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Norihisa Nakagawa, Susono (JP); Shuntaro Okazaki, Shizuoka (JP); Yuji Yamaguchi, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 233 days.

(21) Appl. No.: 15/110,556

(22) PCT Filed: Dec. 18, 2014

(86) PCT No.: PCT/JP2014/084443
§ 371 (c)(1),
(2) Date: Jul. 8, 2016

(87) PCT Pub. No.: WO2015/105012
PCT Pub. Date: Jul. 16, 2015

(65) Prior Publication Data

US 2016/0326975 A1 Nov. 10, 2016

(30) Foreign Application Priority Data

Jan. 10, 2014 (JP) ..... 2014-003420

(51) Int. Cl.
*F01N 3/08* (2006.01)
*F02D 41/02* (2006.01)
(Continued)

(52) U.S. Cl.
CPC ..... *F02D 41/0295* (2013.01); *F01N 3/0864* (2013.01); *F01N 3/20* (2013.01);
(Continued)

(58) Field of Classification Search
CPC .. F01N 3/0864; F01N 3/20; F01N 2900/1402; F02D 41/0295; F02D 41/1441;
(Continued)

(56) References Cited

U.S. PATENT DOCUMENTS 5,678,402 A * 10/1997 Kitagawa ..... F01N 9/005 60/276
5,758,490 A 6/1998 Maki et al.
(Continued)

FOREIGN PATENT DOCUMENTS

DE 10 2004 038 481 B3 7/2005
JP H08-232723 A 9/1996
(Continued)

*Primary Examiner* — Laert Dounis
*Assistant Examiner* — Matthew T Largi
(74) *Attorney, Agent, or Firm* — Hunton Andrews Kurth LLP

(57) ABSTRACT

A control system of an internal combustion engine which can suppress a drop in the purification performance of an exhaust purification catalyst is provided. The control system of an internal combustion engine is provided with an exhaust purification catalyst and downstream side air-fuel ratio sensor, performs feedback control so that an air-fuel ratio of the exhaust gas which flows into the exhaust purification catalyst becomes a target air-fuel ratio, and performs target air-fuel ratio setting control which alternately switches the target air-fuel ratio to a lean set air-fuel ratio which is leaner than a stoichiometric air-fuel ratio and a rich set air-fuel ratio which is richer than the stoichiometric air-fuel ratio. In the control system, when an engine operating state is a steady operating state, compared with when it is not a steady operating state, at least one of a rich degree of the rich set air-fuel ratio or a lean degree of the lean set air-fuel ratio is made to increase.

12 Claims, 15 Drawing Sheets

(51) Int. Cl.
*F02D 41/14* (2006.01)
*F01N 3/20* (2006.01)
*F02D 41/30* (2006.01)

(52) U.S. Cl.
CPC ..... *F02D 41/1441* (2013.01); *F02D 41/1454* (2013.01); *F02D 41/1475* (2013.01); *F02D 41/3005* (2013.01); *F01N 2900/1402* (2013.01); *F02D 2200/0814* (2013.01)

(58) Field of Classification Search
CPC ..... F02D 41/1454; F02D 41/1475; F02D 41/3005; F02D 2200/0814
See application file for complete search history.

(56) References Cited

U.S. PATENT DOCUMENTS 5,867,983 A * 2/1999 Otani ..... F02D 37/02 123/406.23
6,003,308 A * 12/1999 Tsutsumi ..... F01N 11/002 60/276
6,289,673 B1 * 9/2001 Tayama ..... F02D 41/0295 60/274
6,314,723 B1 * 11/2001 Ketterer ..... F01N 9/005 60/274
2006/0032216 A1 2/2006 Odendall
2008/0314023 A1 12/2008 Pohmerer et al.
2016/0061084 A1 3/2016 Okazaki et al.

FOREIGN PATENT DOCUMENTS

JP 2004-251123 A 9/2004
JP 2004-285948 A 10/2004
JP 2012-127305 A 7/2012
WO 2005/083250 A1 9/2005
WO 2014/118892 A1 8/2014

* cited by examiner

CONTROL SYSTEM OF INTERNAL COMBUSTION ENGINE

CROSS-REFERENCE TO RELATED APPLICATIONS

This is a national phase application based on the PCT International Patent Application No. PCT/JP2014/084443 filed Dec. 18, 2014, claiming priority to Japanese Patent Application No. 2014-003420 filed Jan. 10, 2014, the entire contents of both of which are incorporated herein by reference.

TECHNICAL FIELD

The present invention relates to a control system of an internal combustion engine.

BACKGROUND ART

In the past, a control system of an internal combustion engine which is provided with an air-fuel ratio sensor in an exhaust passage of the internal combustion engine, and controls the amount of fuel supplied to the internal combustion engine based on the output of this air-fuel ratio sensor has been widely known. In particular, as such a control system, one which is provided with an air-fuel ratio sensor at an upstream side of an exhaust purification catalyst which is provided in the engine exhaust passage and which is provided with an oxygen sensor at a downstream side thereof is known (for example, PLT's 1 to 2).

In particular, in the control system described in PLT 1, the amount of fuel fed to the internal combustion engine is controlled in accordance with the air-fuel ratio detected by the upstream side air-fuel ratio sensor so that this air-fuel ratio becomes a target air-fuel ratio. In addition, the target air-fuel ratio is corrected in accordance with the oxygen concentration detected by the downstream side oxygen sensor. According to PLT 1, due to this even if the upstream side air-fuel ratio sensor deteriorates due to age or there are individual variability, the air-fuel ratio of the exhaust gas flowing into the exhaust purification catalyst can match with the target value.

CITATION LIST

Patent Literature

PLT 1: Japanese Patent Publication No. 232723A
PLT 2: Japanese Patent Publication No. 2004-285948A
PLT 3: Japanese Patent Publication No. 2004-251123A
PLT 4: Japanese Patent Publication No. 2012-127305A

SUMMARY OF INVENTION

Technical Problem

In this regard, the inventors of this application proposed a control system which performs control different from the control system described in the above-mentioned PLT 1. In this control system, when the air-fuel ratio detected by the downstream side air-fuel ratio sensor becomes a rich judgment air-fuel ratio (air-fuel ratio slightly leaner than stoichiometric air-fuel ratio) or less, the target air-fuel ratio is set to an air-fuel ratio leaner than the stoichiometric air-fuel ratio (below, referred to as a "lean air-fuel ratio"). On the other hand, while the target air-fuel ratio is set to the lean air-fuel ratio, when the oxygen storage amount of the exhaust purification catalyst becomes a switching reference storage amount or more, the target air-fuel ratio is set to an air-fuel ratio richer than the stoichiometric air-fuel ratio (below, referred to as a "rich air-fuel ratio"). The switching reference storage amount is set to an amount smaller than the maximum storable oxygen amount in the new product state.

If such a control system is used for control, the target air-fuel ratio is switched from the lean air-fuel ratio to the rich air-fuel ratio before the oxygen storage amount of the exhaust purification catalyst reaches the maximum storable oxygen amount. Therefore, according to this control, lean air-fuel ratio exhaust gas will almost never flow out from the exhaust purification catalyst. As a result, $NO_x$ can be kept from flowing out from the exhaust purification catalyst.

In this regard, the oxygen storage amount of the exhaust purification catalyst is maintained by repeatedly storing and releasing oxygen. Therefore, if the exhaust purification catalyst is maintained in a state in which oxygen is stored for a long time period or is maintained in a state in which oxygen is released for a long time period, the oxygen storage capacity will drop, and a fall in the purification performance of the exhaust purification catalyst will be invited. Specifically, for example, the exhaust purification catalyst will fall in maximum storable oxygen amount.

Further, to maintain the oxygen storage capacity of the exhaust purification catalyst high, as explained above, it is effective to alternately set the target air-fuel ratio of the exhaust gas flowing into the exhaust purification catalyst to the lean air-fuel ratio and the rich air-fuel ratio so that the exhaust purification catalyst can store and release oxygen. Here, the oxygen storage capacity of the exhaust purification catalyst is maintained higher the larger the lean degree when the target air-fuel ratio is a lean air-fuel ratio (difference from stoichiometric air-fuel ratio) and the rich degree when the target air-fuel ratio is a rich air-fuel ratio (difference from stoichiometric air-fuel ratio).

On the other hand, if increasing the rich degree and the lean degree of the target air-fuel ratio, when exhaust gas containing unburned gas or $NO_x$ etc. flows out at the exhaust purification catalyst, the unburned gas or $NO_x$ etc. contained in the exhaust gas is greater.

In view of the above problem, an object of the present invention is to provide a control system of an internal combustion engine which keeps low the unburned gas or $NO_x$ flowing out from the exhaust purification catalyst while maintaining high the purification performance of the exhaust purification catalyst.

Solution to Problem

To solve this problem, in a first aspect of the invention, there is provided a control system of an internal combustion engine, the internal combustion engine comprising an exhaust purification catalyst which is arranged in an exhaust passage of the internal combustion engine and which can store oxygen, the control system of an internal combustion engine performing feedback control so that an air-fuel ratio of the exhaust gas flowing into the exhaust purification catalyst becomes a target air-fuel ratio and performing target air-fuel ratio setting control which alternately switches the target air-fuel ratio to a lean set air-fuel ratio which is leaner than a stoichiometric air-fuel ratio and a rich set air-fuel ratio which is richer than the stoichiometric air-fuel ratio, wherein when an engine operating state is a steady operating state, compared with when it is not a steady operating state, at least one of a rich degree of the rich set air-fuel ratio or a lean degree of the lean set air-fuel ratio is increased.

In a second aspect of the invention, there is provided the first aspect of the invention, wherein the internal combustion engine comprises a downstream side air-fuel ratio sensor which is arranged at a downstream side of the exhaust purification catalyst in an exhaust flow direction and which detects the air-fuel ratio of the exhaust gas flowing out from the exhaust purification catalyst, wherein in the target air-fuel ratio setting control, the target air-fuel ratio is switched to the lean set air-fuel ratio when the air-fuel ratio detected by the downstream side air-fuel ratio sensor becomes the rich judgment air-fuel ratio or less and is switched to the rich set air-fuel ratio when an oxygen storage amount of the exhaust purification catalyst becomes a predetermined switching reference storage amount smaller than the maximum storable oxygen amount, and wherein during execution of the feedback control and the target air-fuel ratio setting control, when a condition for increasing the reference storage amount stands, the switching reference storage amount is increased over the amount up to then.

To solve the problem, in a third aspect of the invention, there is provided a control system of an internal combustion engine, the internal combustion engine comprising an exhaust purification catalyst which is arranged in an exhaust passage of the internal combustion engine and which can store oxygen, and a downstream side air-fuel ratio sensor which is arranged at a downstream side of the exhaust purification catalyst in an exhaust flow direction and which detects the air-fuel ratio of the exhaust gas flowing out from the exhaust purification catalyst, the control system of an internal combustion engine performing feedback control so that an air-fuel ratio of the exhaust gas flowing into the exhaust purification catalyst becomes a target air-fuel ratio, and performing target air-fuel ratio setting control which switches the target air-fuel ratio to a lean set air-fuel ratio which is leaner than a stoichiometric air-fuel ratio when the air-fuel ratio detected by the downstream side air-fuel ratio sensor becomes a rich judgment air-fuel ratio or less and which switches the target air-fuel ratio to a rich set air-fuel ratio which is richer than the stoichiometric air-fuel ratio when an oxygen storage amount of the exhaust purification catalyst becomes a predetermined switching reference storage amount smaller than the maximum storable oxygen amount or more, wherein during execution of the feedback control and the target air-fuel ratio setting control, when a condition for increasing the reference storage amount stands, the switching reference storage amount is increased over the amount up to then.

In a fourth aspect of the invention, there is provided a second or third aspect of the invention wherein the condition for increasing the reference storage amount stands when a cumulative exhaust gas amount which is cumulatively added from a point of time in a period from when the last performed fuel cut control ends to when the output air-fuel ratio of the downstream side air-fuel ratio sensor reaches the rich judgment air-fuel ratio, becomes a predetermined reference cumulative exhaust gas amount or more.

In a fifth aspect of the invention, there is provided a second or third aspect of the invention wherein the condition for increasing the reference storage amount stands when an elapsed time from a point of time in a period from when the last performed fuel cut control ends to when the output air-fuel ratio of the downstream side air-fuel ratio sensor reaches the stoichiometric air-fuel ratio becomes a predetermined elapsed time or more.

In a sixth aspect of the invention, there is provided a second or third aspect of the invention wherein the condition for increasing the reference storage amount stands when a cumulative exhaust gas amount which is cumulatively added from when the output air-fuel ratio of the downstream side air-fuel ratio sensor last reaches a lean judgment air-fuel ratio, which is leaner than the stoichiometric air-fuel ratio, or more, and then becomes smaller than the lean judgment air-fuel ratio, becomes a predetermined reference cumulative exhaust gas amount or more.

In a seventh aspect of the invention, there is provided a second or third aspect of the invention wherein the condition for increasing the reference storage amount stands when a cumulative exhaust gas amount which is cumulatively added from when the last performed fuel cut control ends to when the output air-fuel ratio of the downstream side air-fuel ratio sensor reaches the stoichiometric air-fuel ratio is a predetermined reference cumulative exhaust gas amount or more and an amount of flow of exhaust gas flowing into the exhaust purification catalyst is an upper limit amount of flow or less.

In a eighth aspect of the invention, there is provided a second or third aspect of the invention wherein the condition for increasing the reference storage amount stands when an elapsed time from a point of time in a period from when the last performed fuel cut control ends to when the output air-fuel ratio of the downstream side air-fuel ratio sensor reaches the stoichiometric air-fuel ratio is a predetermined elapsed time or more and an amount of flow of exhaust gas flowing into the exhaust purification catalyst is an upper limit amount of flow or less.

Advantageous Effects of Invention

According to the present invention, provided is a control system of an internal combustion engine which keeps low the unburned gas or $NO_x$ flowing out from the exhaust purification catalyst while maintaining high the purification performance of the exhaust purification catalyst.

DESCRIPTION OF EMBODIMENTS

Figure 1:
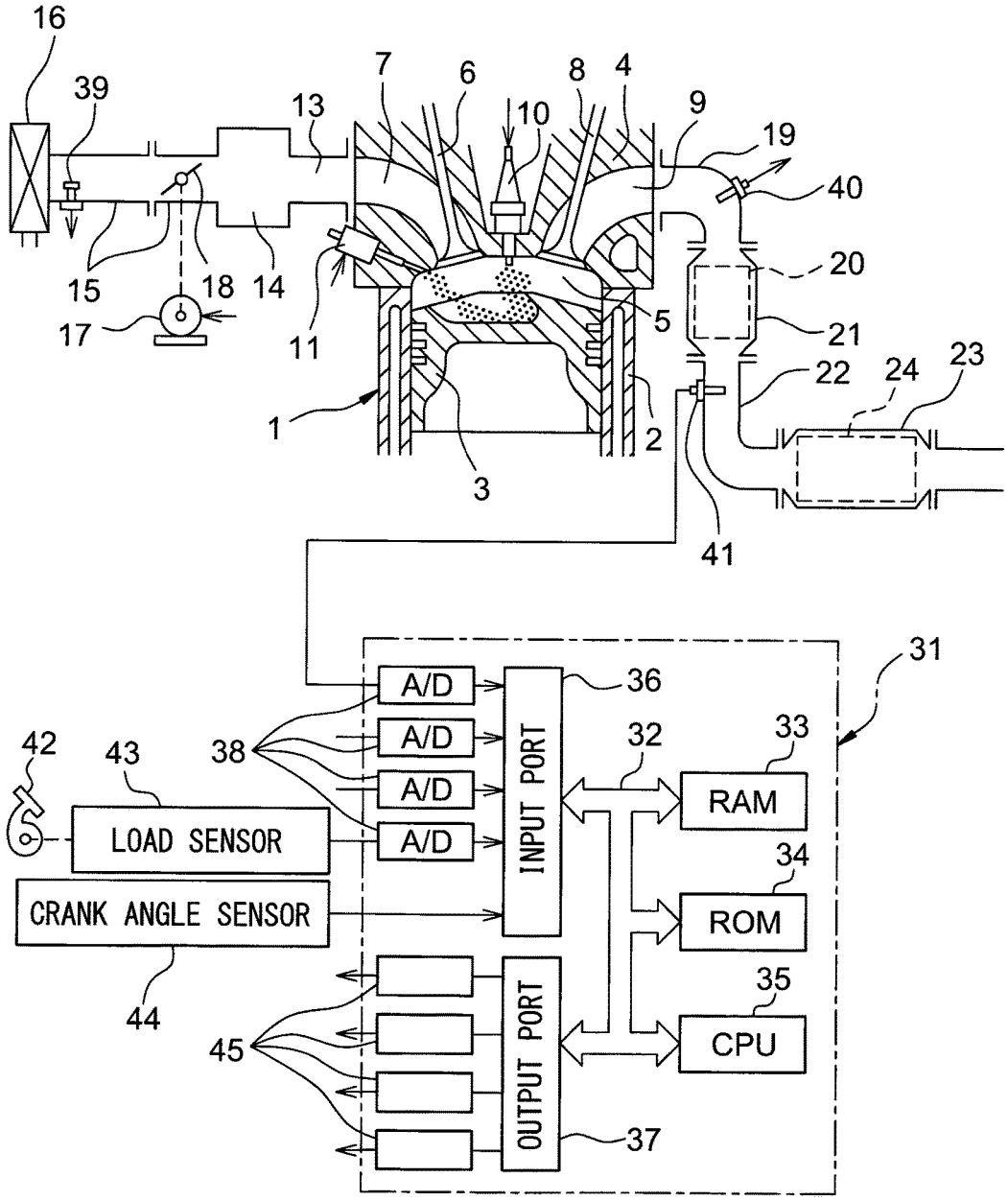
FIG. 1 is a view which schematically shows an internal combustion engine in which a control device of the present invention is used.

Below, referring to the drawings, embodiments of the present invention will be explained in detail. Note that, in the following explanation, similar component elements are assigned the same reference numerals.

<Explanation of Internal Combustion Engine as a Whole>

FIG. 1 is a view which schematically shows an internal combustion engine in which a control system according to a first embodiment of the present invention is used. In FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present invention may also use another fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 consists of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, the ECU 31 functions as a control system for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have a number of cylinders, cylinder array, way of fuel injection, configuration of intake and exhaust systems, configuration of valve mechanism, presence of supercharger, and/or supercharging way, etc. which are different from the above internal combustion engine.

<Explanation of Exhaust Purification Catalyst>

The upstream side exhaust purification catalyst 20 and downstream side exhaust purification catalyst 24 have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_x$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

Figure 2A:
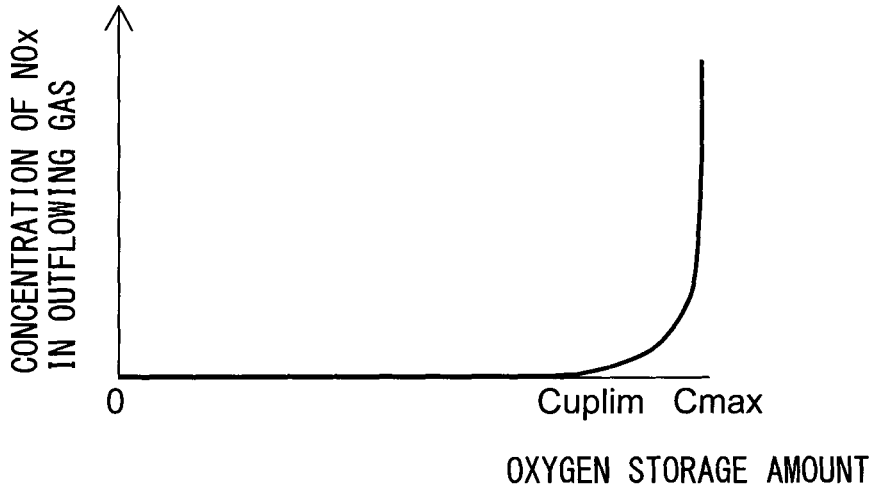
FIG. 2 is a view which shows the relationship between the stored amount of oxygen of the exhaust purification catalyst and concentration of $NO_x$ or concentration of HC or CO in the exhaust gas flowing out from the exhaust purification catalyst.

The exhaust purification catalysts 20 and 24 have a catalytic action and oxygen storage ability and thereby have the action of purifying $NO_x$ and unburned gas according to the stored amount of oxygen. That is, as shown on solid line in FIG. 2A, in the case where the air-fuel ratio of the exhaust gas flowing into the exhaust purification catalysts 20 and 24 is a lean air-fuel ratio, when the stored amount of oxygen is small, the exhaust purification catalysts 20 and 24 store the oxygen in the exhaust gas. Further, along with this, the $NO_x$ in the exhaust gas is reduced and purified. On the other hand, if the stored amount of oxygen becomes larger beyond a certain stored amount near the maximum storable oxygen amount Cmax (in the figure, Cuplim), the exhaust gas flowing out from the exhaust purification catalysts 20 and 24 rises in concentration of oxygen and $NO_x$.

Figure 2B:
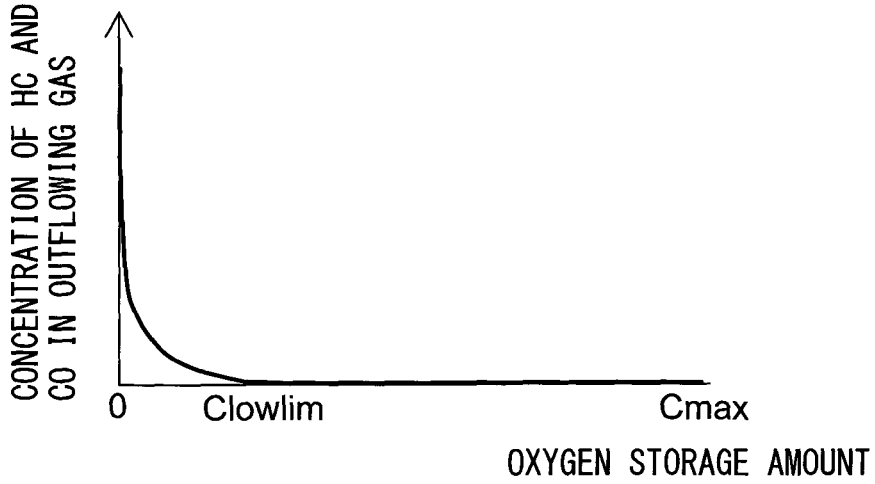

On the other hand, as shown on solid line in FIG. 2B, in the case where the air-fuel ratio of the exhaust gas flowing into the exhaust purification catalysts 20 and 24 is the rich air-fuel ratio, when the stored amount of oxygen is large, the oxygen stored in the exhaust purification catalysts 20 and 24 is released, and the unburned gas in the exhaust gas is oxidized and purified. On the other hand, if the stored amount of oxygen becomes small, the exhaust gas flowing out from the exhaust purification catalysts 20 and 24 rapidly rises in concentration of unburned gas at a certain stored amount near zero (in the figure, Cdwnlim).

In the above way, according to the exhaust purification catalysts 20 and 24 used in the present embodiment, the purification characteristics of $NO_x$ and unburned gas in the exhaust gas change depending on the air-fuel ratio and stored amount of oxygen of, the exhaust gas flowing into the exhaust purification catalysts 20 and 24. Note that, if having a catalytic action and oxygen storage ability, the exhaust purification catalysts 20 and 24 may also be catalysts different from three-way catalysts.

<Configuration of Air-Fuel Ratio Sensor>

Figure 3:
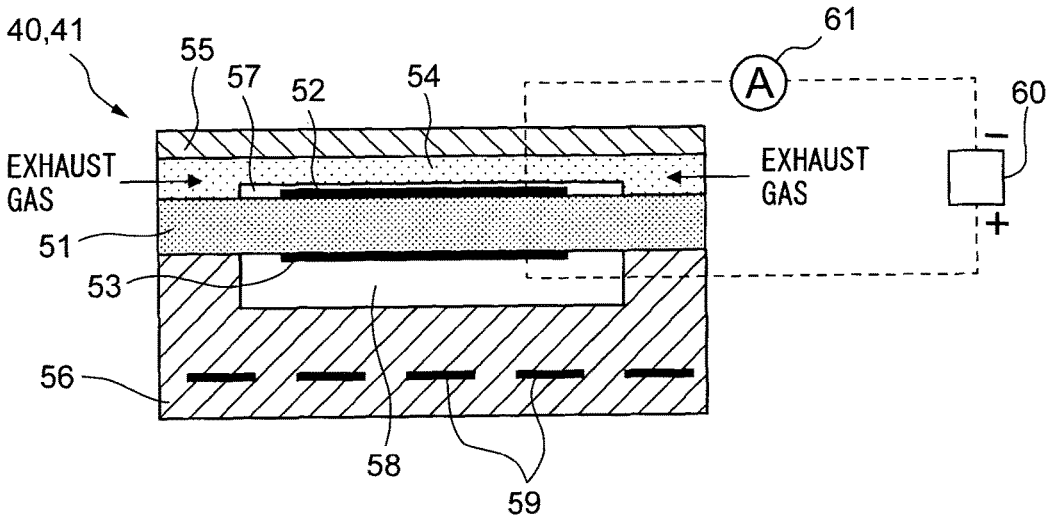
FIG. 3 is a schematic cross-sectional view of an air-fuel ratio sensor.

Next, referring to FIG. 3, the configurations of air-fuel ratio sensors 40 and 41 in the present embodiment will be explained. FIG. 3 is a schematic cross-sectional view of air-fuel ratio sensors 40 and 41. As will be understood from FIG. 3, the air-fuel ratio sensors 40 and 41 in the present embodiment are single-cell type air-fuel ratio sensors each having a single cell which comprises a solid electrolyte layer and a pair of electrodes. Note that, in this embodiment, the air-fuel ratio sensor having the same configurations is used as both air-fuel ratio sensors 40 and 41.

As shown in FIG. 3, each of the air-fuel ratio sensors 40 and 41 comprises a solid electrolyte layer 51, an exhaust side electrode 52 arranged at one side surface of the solid electrolyte layer 51, an atmosphere side electrode 53 arranged at the other side surface of the solid electrolyte layer 51, a diffusion regulation layer 54 which regulates the diffusion of the passing exhaust gas, a protective layer 55 for protecting the diffusion regulation layer 54, and a heater part 56 for heating the air-fuel ratio sensor 40 or 41.

On one side surface of the solid electrolyte layer 51, a diffusion regulation layer 54 is provided. On the side surface of the diffusion regulation layer 54 at the opposite side from the side surface of the solid electrolyte layer 51 side, a protective layer 55 is provided. In the present embodiment, a measured gas chamber 57 is formed between the solid electrolyte layer 51 and the diffusion regulation layer 54. The exhaust side electrode 52 is arranged in the measured gas chamber 57, and the exhaust gas is introduced through the diffusion regulation layer 54 into the measured gas chamber 57. On the other side surface of the solid electrolyte layer 51, the heater part 56 having heaters 59 is provided. Between the solid electrolyte layer 51 and the heater part 56, a reference gas chamber 58 is formed. Inside this reference gas chamber 58, a reference gas (for example, atmospheric gas) is introduced. The atmosphere side electrode 53 is arranged inside the reference gas chamber 58.

The solid electrolyte layer 51 is formed by a sintered body of $ZrO_2$ (zirconia), $HfO_2$, $ThO_2$, $Bi_2O_3$, or other oxygen ion conducting oxide in which CaO, MgO, $Y_2O_3$, $Yb_2O_3$, etc. is blended as a stabilizer. Further, the diffusion regulation layer 54 is formed by a porous sintered body of alumina, magnesia, silica, spinel, mullite, or another heat resistant inorganic substance. Furthermore, the exhaust side electrode 52 and atmosphere side electrode 53 are formed by platinum or other precious metal with a high catalytic activity.

Further, between the exhaust side electrode 52 and the atmosphere side electrode 53, sensor voltage Vr is applied by the voltage apply device 60 which is mounted on the ECU 31. In addition, the ECU 31 is provided with a current detection device 61 which detects the current flowing between these electrodes 52 and 53 through the solid electrolyte layer 51 when the voltage apply device 60 applies the sensor voltage Vr. The current detected by this current detection device 61 is the output current of the air-fuel ratio sensors 40 and 41.

Figure 4:
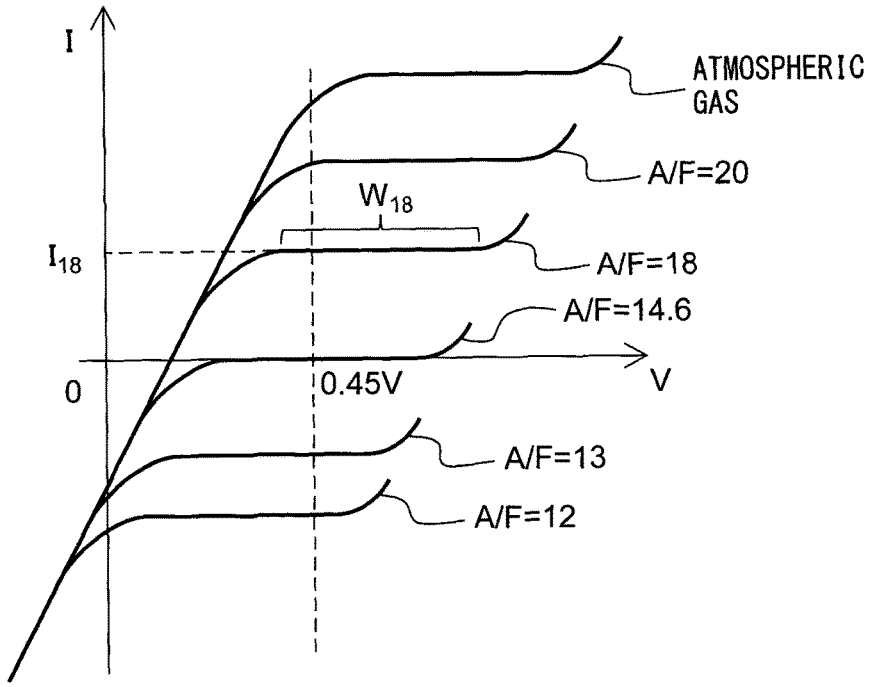
FIG. 4 is a view which shows the relationship between the voltage applied to the sensor and output current, at different exhaust air-fuel ratios.

The thus configured air-fuel ratio sensors 40 and 41 have the voltage-current (V-I) characteristic such as shown in FIG. 4. As will be understood from FIG. 4, the output current I becomes larger the higher (the leaner) the exhaust air-fuel ratio. Further, at the line V-I of each exhaust air-fuel ratio, there is a region parallel to the V axis, that is, a region where the output current does not change much at all even if the sensor voltage changes. This voltage region is called the "limit current region". The current at this time is called the "limit current". In FIG. 4, the limit current region and limit current when the exhaust air-fuel ratio is 18 are shown by $W_{18}$ and $I_{18}$.

Figure 5:
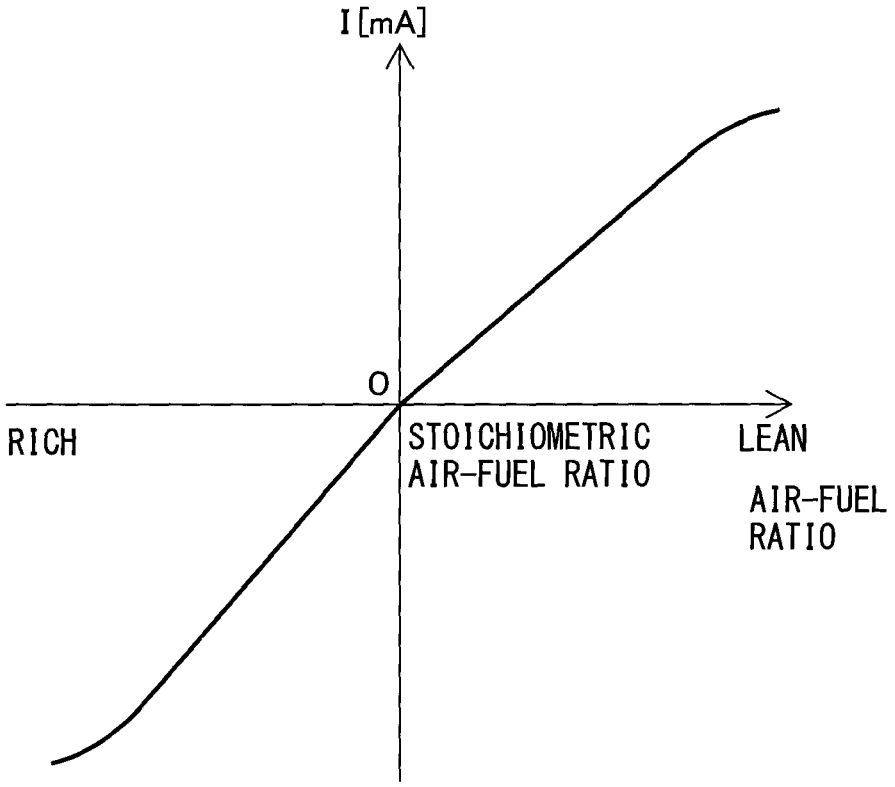
FIG. 5 is a view which shows the relationship between the exhaust air-fuel ratio and output current when making the voltage applied to the sensor constant.

FIG. 5 is a view which shows the relationship between the exhaust air-fuel ratio and the output current I when making the supplied voltage constant at about 0.45V. As will be understood from FIG. 5, in the air-fuel ratio sensors 40 and 41, the output current is linearly changed with respect to the exhaust air fuel ratio such that the higher the exhaust air-fuel ratio (that is, the leaner), the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors of the structure shown in FIG. 3 are used. However, as the air-fuel ratio sensors 40, 41 for example, it is also possible to use a cup-type limit current type air-fuel ratio sensor or other structure of limit current type air-fuel ratio sensor or air-fuel ratio sensor not a limit current type or any other air-fuel ratio sensor, as long as the output current changes linearly with respect to the exhaust air-fuel ratio. Further, the air-fuel ratio sensors 40 and 41 may have a structure different from each other.

<Basic Air Fuel Ratio Control>

Next, an outline of the basic air-fuel ratio control in a control device of an internal combustion engine of the present invention will be explained. In the air-fuel ratio control in the present embodiment, the a feedback control is performed so that the output air-fuel ratio of the upstream side air-fuel ratio sensor 40 (corresponding to air-fuel ratio of exhaust gas flowing into the upstream side exhaust purification catalyst 20) becomes a value corresponding to the target air-fuel ratio, based on the output air-fuel ratio of the upstream side air-fuel ratio. Note that, "output air-fuel ratio" means air-fuel ratio corresponding to the output value of an air-fuel ratio sensor.

On the other hand, in the air-fuel control of the present embodiment, a target air-fuel ratio setting control for setting the target air-fuel ratio is performed based on the output air-fuel ratio of the downstream side air-fuel ratio sensor 41 etc. In the target air-fuel ratio setting control, when the output air-fuel ratio of the downstream side air-fuel ratio sensor 41 becomes the rich air-fuel ratio, the target air-fuel ratio is made the lean set air-fuel ratio. After this, it is maintained at this air-fuel ratio. Note that, the lean set air-fuel ratio is a predetermined air-fuel ratio which is leaner by a certain extent than the stoichiometric air-fuel ratio (an air-fuel ratio of center of control). For example, it is made 14.65 to 20, preferably 14.68 to 18, more preferably 14.7 to 16 or so. Further, the lean set air-fuel ratio can be expressed as an air-fuel ratio obtained by adding a lean correction amount to the air-fuel ratio of center of control (in the present embodiment, stoichiometric air-fuel ratio).

If the target air-fuel ratio is changed to the lean set air-fuel ratio, the oxygen excess/deficiency of the exhaust gas flowing into the upstream side exhaust purification catalyst 20 is cumulatively added. The "oxygen excess/deficiency" means the amount of the oxygen which becomes excessive or the amount of the oxygen which becomes deficient (amount of excess unburned gas etc.) when trying to make the air-fuel ratio of the exhaust gas flowing into the upstream side exhaust purification catalyst 20 the stoichiometric air-fuel ratio. In particular, when the target air-fuel ratio is the lean set air-fuel ratio, the exhaust gas flowing into the upstream side exhaust purification catalyst 20 becomes excessive in oxygen. This excess oxygen is stored in the upstream side exhaust purification catalyst 20. Therefore, the cumulative value of the oxygen excess/deficiency (below, also referred to as the "cumulative oxygen excess/deficiency") can be said to express the stored amount of oxygen OSA of the upstream side exhaust purification catalyst 20.

Note that, the oxygen excess/deficiency is calculated based on the output air-fuel ratio of the upstream side air-fuel ratio sensor 40 and the estimated value of the intake air amount to the inside of the combustion chamber 5 which is calculated based on the airflow meter 39 etc. or the fuel feed amount of the fuel injector 11 etc. Specifically, the oxygen excess/deficiency OED is, for example, calculated by the following formula (1):

$$ODE=0.23\cdot Qi/(AFup\ 14.6) \quad (1)$$

where 0.23 indicates the concentration of oxygen in the air, Qi indicates the amount of fuel injection, and AFup indicates the air-fuel ratio corresponding to the output current Irup of the upstream side air-fuel ratio sensor 40.

If the thus calculated oxygen excess/deficiency becomes the predetermined switching reference value (corresponding to predetermined switching reference storage amount Cref) or more, the target air-fuel ratio, which had up to that time been the lean set air-fuel ratio, is made the rich set air-fuel ratio, then is maintained at this air-fuel ratio. The rich set air-fuel ratio is a predetermined air-fuel ratio which is richer than the stoichiometric air-fuel ratio (air-fuel ratio of center of control) in a certain degree. For example, it is 12 to 14.58, preferably 13 to 14.57, more preferably 14 to 14.55 or so. Further, the rich set air-fuel ratio can be expressed as an air-fuel ratio obtained by subtracting a rich correction amount from the air-fuel ratio of center of control (in the present embodiment, stoichiometric air-fuel ratio). Note that, the difference of the rich set air-fuel ratio from the stoichiometric air-fuel ratio (rich degree) is the difference of the lean set air-fuel ratio from the stoichiometric air-fuel ratio (lean degree) or less. After this, when the output air-fuel ratio of the downstream side air-fuel ratio sensor 41 again becomes the rich judgment air-fuel ratio or less, the target air-fuel ratio is again made the lean set air-fuel ratio. After this, a similar operation is repeated.

In this way, in the present embodiment, the target air-fuel ratio of the exhaust gas flowing into the upstream side exhaust purification catalyst 20 is alternately set to the lean set air-fuel ratio and the rich set air-fuel ratio. In particular, in the present embodiment, the difference of the lean set air-fuel ratio from the stoichiometric air-fuel ratio is the difference of the rich set air-fuel ratio from the stoichiometric air-fuel ratio or more. Therefore, in the present embodiment, the target air-fuel ratio is alternately, set to a short time period lean set air-fuel ratio and a long time period rich set, air-fuel ratio.

However, even if performing the control stated above, the actual oxygen storage amount of the upstream side exhaust purification catalyst 20 may reach the maximum storable oxygen amount before the cumulative oxygen excess/deficiency reaches the switching reference value. As a reason for it, the reduction of the maximum storable oxygen amount of the upstream side exhaust purification catalyst 20 or temporal changes in the air-fuel ratio of the exhaust gas flowing into the upstream side exhaust purification catalyst 20 can be considered. If the oxygen storage amount reaches the maximum storable oxygen amount as such, the exhaust gas of lean air-fuel ratio flows out from the upstream side exhaust purification catalyst 20. Therefore, in the present embodiment, when the output air-fuel ratio of the downstream side air-fuel ratio sensor 41 becomes a lean air-fuel ratio, the target air-fuel ratio is switched to the rich set air-fuel ratio. In particular, in the present embodiment, when the output air-fuel ratio of the downstream side air-fuel ratio sensor 41 becomes a lean judgment air-fuel ratio which is slightly leaner than the stoichiometric air-fuel ratio, it is judged that the output air-fuel ratio of the downstream side air-fuel sensor 41 becomes a lean air-fuel ratio.

<Explanation of Air Fuel Ratio Control Using Time Chart>

Figure 6:
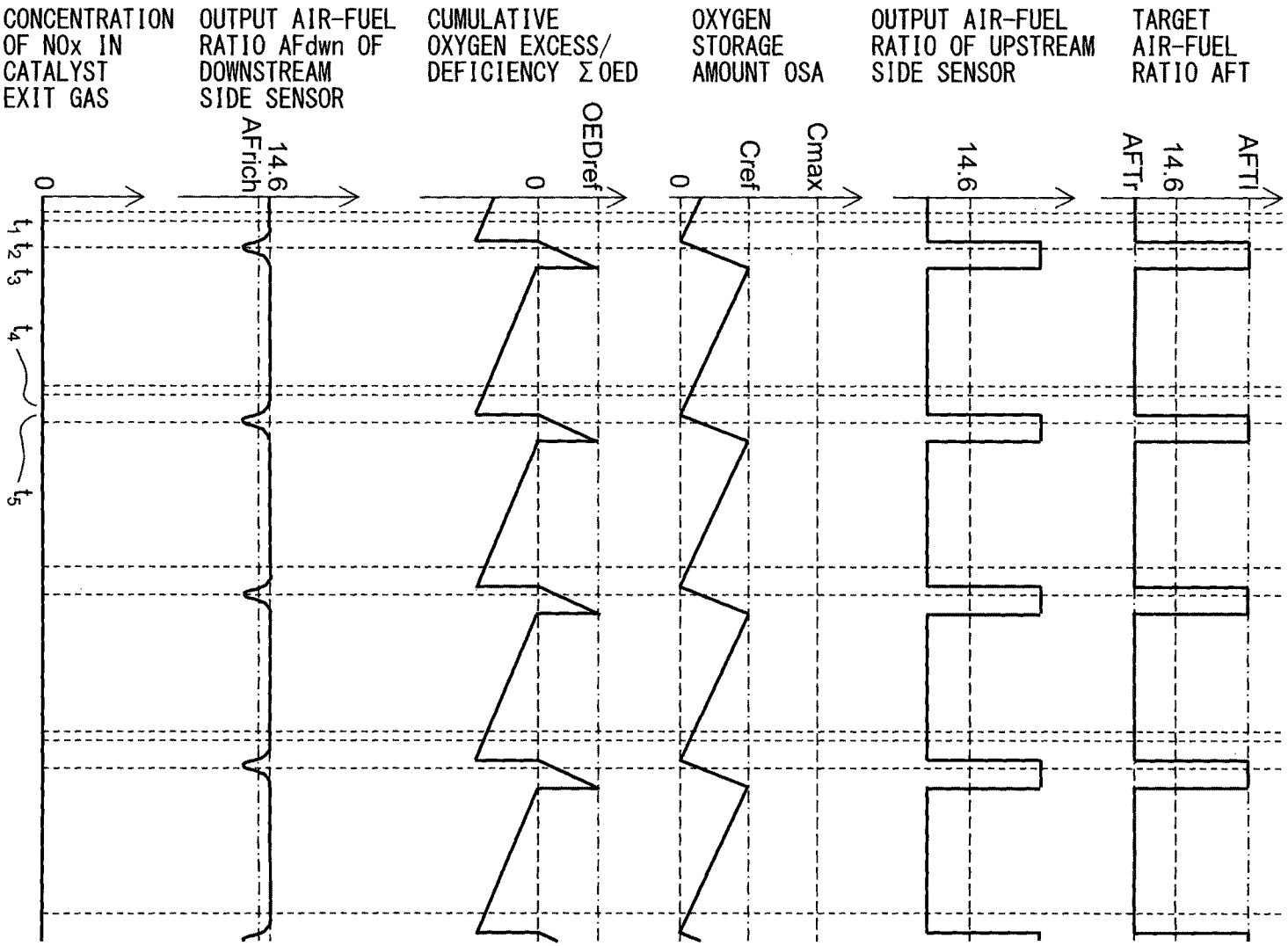
FIG. 6 is a time chart of a target air-fuel ratio etc. when performing the air-fuel ratio control.

Referring to FIG. 6, the operation explained as above will be explained in detail. FIG. 6 is a time chart of the target air-fuel ratio AFT, the output air-fuel ratio AFup of the upstream side air-fuel ratio sensor 40, the stored amount of oxygen OSA of the upstream side exhaust purification catalyst 20, the cumulative oxygen excess/deficiency ΣOED, the output air-fuel ratio AFdwn of the downstream side air-fuel ratio sensor 41, and the concentration of $NO_x$ in the exhaust gas flowing out from the upstream side exhaust purification catalyst 20, when performing the air-fuel ratio control of the present embodiment.

In the illustrated example, in the state before the time $t_1$, the target air-fuel ratio AFT is set to the rich set air-fuel ratio AFTr. Along with this, the output air-fuel ratio of the upstream side air-fuel ratio sensor 40 becomes a rich air-fuel ratio. Unburned gas contained in the exhaust gas flowing into the upstream side exhaust purification catalyst 20 is purified by the upstream side exhaust purification catalyst 20, and along with this the upstream side exhaust purification catalyst 20 is gradually decreased in the stored amount of oxygen OSA. Therefore, the cumulative oxygen excess/deficiency ΣOED is also gradually decreased. The unburned gas is not contained in the exhaust gas flowing out from the upstream side exhaust purification catalyst 20 by the purification at the upstream side exhaust purification catalyst 20, and therefore the output air-fuel ratio of the downstream side air-fuel ratio sensor 41 becomes substantially stoichiometric air-fuel ratio. Further, since the air-fuel ratio of the exhaust gas flowing into the upstream side exhaust purification catalyst 20 becomes the rich air-fuel ratio, the amount of $NO_x$ exhausted from the upstream side exhaust purification catalyst 20 becomes substantially zero.

If the upstream side exhaust purification catalyst 20 gradually decreases in stored amount of oxygen OSA, the stored amount of oxygen OSA approaches zero at the time $t_1$. Along with this, part of the unburned gas flowing into the upstream side exhaust purification catalyst 20 starts to flow out without being purified by the upstream side exhaust purification catalyst 20. Due to this, from the time $t_1$ on, the output air-fuel ratio AFdwn of the downstream side air-fuel ratio sensor 41 gradually falls. As a result, at the time $t_2$, the output air-fuel ratio AFdwn of the downstream side air-fuel ratio sensor 41 reaches the rich judgment air-fuel ratio AFrich.

In the present embodiment, when the output air-fuel ratio AFdwn of the downstream side air-fuel ratio sensor 41 becomes the rich judgment air-fuel ratio AFrich or less, to increase the stored amount of oxygen OSA, the target air-fuel ratio AFT is switched to the lean set air-fuel ratio AFT1. Further, at this time, the cumulative oxygen excess/deficiency ΣOED is reset to 0.

When the target air-fuel ratio AFT is switched to the lean set air-fuel ratio AFT1 at the time $t_2$, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from when the target air-fuel ratio is switched to when the air-fuel ratio of the exhaust gas flowing into the upstream side exhaust purification catalyst 20 changes, but in the illustrated example, it is deemed for convenience that the change is simultaneous). If at the time $t_2$ the air-fuel ratio of the exhaust gas flowing into the upstream side exhaust purification catalyst 20 changes to the lean air-fuel ratio, the upstream side exhaust purification catalyst 20 increases in the stored amount of oxygen OSA. Further, along with this, the cumulative oxygen excess/deficiency ΣOED also gradually increases.

Due to this, the air-fuel ratio of the exhaust gas flowing out from the upstream side exhaust purification catalyst 20 changes to the stoichiometric air-fuel ratio, and the output air-fuel ratio of the downstream side air-fuel ratio sensor 41 converges to the stoichiometric air-fuel ratio. At this time, the air-fuel ratio of the exhaust gas flowing into the upstream side exhaust purification catalyst 20 becomes, the lean air-fuel ratio, but there is sufficient leeway in the oxygen storage ability of the upstream side exhaust purification catalyst 20, and therefore the oxygen in the inflowing exhaust gas is stored in the upstream side exhaust purification catalyst 20 and the $NO_x$ is reduced and purified. Therefore, the exhaust amount of NOx from the upstream side exhaust purification catalyst 20 is substantially zero.

After this, if the upstream side exhaust purification catalyst 20 increases in stored amount of oxygen OSA, at the time $t_3$, the stored amount of oxygen OSA of the upstream side exhaust purification catalyst 20 reaches the switching reference storage amount Cref. For this reason, the cumulative oxygen excess/deficiency ΣOED reaches the switching reference value OEDref which corresponds to the switching reference storage amount Cref. In the present embodiment, if the cumulative oxygen excess/deficiency ΣOED becomes the switching reference value OEDref or more, the storage of oxygen in the upstream side exhaust purification catalyst 20 is suspended by switching the target air-fuel ratio AFT to the rich set air-fuel ratio AFTr. Further, at this time, the cumulative oxygen excess/deficiency ΣOED is reset to 0.

Here, in the example which is shown in FIG. 6, the stored amount of oxygen OSA falls simultaneously with the target air-fuel ratio being switched at the time $t_3$, but in actuality, a delay occurs from when the target air-fuel ratio is switched to when the stored amount of oxygen OSA falls. Further, the air-fuel ratio of the exhaust gas flowing into the upstream side exhaust purification catalyst 20 is sometimes unintentionally significantly shifted, for example, in the case where engine load becomes high by accelerating a vehicle provided with the internal combustion engine, and thus the air intake amount is instantaneously significantly shifted. As opposed to this, the switching reference storage amount Cref is set sufficiently lower than the maximum storable oxygen amount Cmax when the upstream exhaust purification catalyst 20 is new. For this reason, even if such a delay occurs, or even if the air-fuel ratio is instantaneously intentionally shifted from the target air-fuel ratio, the stored amount of oxygen OSA does not basically reach the maximum storable oxygen amount Cmax. Conversely, the switching reference storage amount Cref is set to an amount sufficiently small so that the stored amount of oxygen OSA does not reach the maximum storable oxygen amount Cmax even if a delay or unintentional shift in air-fuel ratio occurs. For example, the switching reference storage amount Cref is ¾ or less of the maximum storable oxygen amount Cmax when the upstream side exhaust purification catalyst 20 is new, preferably ½ or less, more preferably ⅕ or less.

If the target air-fuel ratio AFT is switched to the rich set air-fuel ratio AFTr at the time $t_3$, the air-fuel ratio of the exhaust gas flowing into the upstream side exhaust purification catalyst 20 changes from the lean air-fuel ratio to the rich air-fuel ratio. Along with this, the output air-fuel ratio AFup of the upstream side air-fuel ratio sensor 40 becomes a rich air-fuel ratio (in actuality, a delay occurs from when the target air-fuel ratio is switched to when the exhaust gas flowing into the upstream side exhaust purification catalyst 20 changes in air-fuel ratio, but in the illustrated example, it is deemed for convenience that the change is simultaneous). The exhaust gas flowing into the upstream side exhaust purification catalyst 20 contains unburned gas, and therefore the upstream side exhaust purification catalyst 20 gradually decreases in stored amount of oxygen OSA. At the time $t_4$, in the same way as the time $t_1$, the output air-fuel ratio AFdwn of the downstream side air-fuel ratio sensor 41 starts to fall. At this time as well, the air-fuel ratio of the exhaust gas flowing into the upstream side exhaust purification catalyst 20 is the rich air-fuel ratio, and therefore $NO_x$ exhausted from the upstream side exhaust purification catalyst 20 is substantially zero.

Next, at the time $t_5$, in the same way as time $t_2$, the output air-fuel ratio AFdwn of the downstream side air-fuel ratio sensor 41 reaches the rich judgment air-fuel ratio AFrich. Due to this, the target air-fuel ratio AFT is switched to the lean set air-fuel ratio AFT1. After this, the cycle of the above mentioned times $t_1$ to $t_5$ is repeated.

As will be understood from the above explanation, according to the present embodiment, it is possible to constantly suppress the amount of $NO_x$ exhausted from the upstream side exhaust purification catalyst 20. That is, as long as performing the control explained above, the exhaust amount of NOx from the upstream side exhaust purification catalyst 20 can basically be zero. Further, since the cumulative period for calculating the cumulative oxygen excess/deficiency ΣOED is short, comparing with the case where the cumulative period is long, a possibility of error occurring is low. Therefore, it is suppressed that NOx is exhausted from the upstream side exhaust purification catalyst 20 due to the calculation error in the cumulative oxygen excess/deficiency ΣOED.

Further, in general, if the stored amount of oxygen of the exhaust purification catalyst is maintained constant, the exhaust purification catalyst falls in oxygen storage ability. That is, it is necessary that the oxygen storage amount of the exhaust purification catalyst is varied in order to maintain the oxygen storage ability of the exhaust purification catalyst high. As opposed to this, according to the present embodiment, as shown in FIG. 6, the stored amount of oxygen OSA of the upstream side exhaust purification catalyst 20 constantly fluctuates up and down, and therefore the oxygen storage ability is kept from falling in a certain extent.

Note that, in the above embodiment, the target air-fuel ratio AFT is maintained to the lean set air-fuel ratio AFT1 in the time $t_2$ to $t_3$. However, in this period, the target air-fuel ratio AFT is not necessarily maintained constant, and can be set so as to vary, for example to be gradually reduced. Alternatively, in the period from the time $t_2$ to time $t_3$, the target air-fuel ratio may be temporally set to the rich air-fuel ratio.

Similarly, in the above embodiment, the target air-fuel ratio AFT is maintained to the rich set air-fuel ratio AFTr in the time $t_3$ to $t_5$. However, in this period, the target air-fuel ratio AFT is not necessarily maintained constant, and can be set so as to vary, for example to be gradually increased. Alternatively, in the period from the time $t_3$ to $t_5$, the target air-fuel ratio may be temporally set to the lean air-fuel ratio.

However, even in this case, the target air-fuel ratio in the time $t_2$ to $t_3$ is set so that the difference between the average value of the target air-fuel ratio at this period and the stoichiometric air-fuel ratio is larger than the difference between the average value of the target air-fuel ratio in the time $t_3$ to $t_5$ and the stoichiometric air-fuel ratio.

Note that, in the present embodiment, setting of the target air-fuel ratio is performed by the ECU 31. Therefore, it can be said that when the air-fuel ratio of the exhaust gas detected by the downstream side air-fuel ratio sensor 41 becomes the rich judgment air-fuel ratio or less, the ECU 31 makes the target air-fuel ratio of the exhaust gas flowing into the upstream side exhaust purification catalyst 20 the lean air-fuel ratio continuously or intermittently until the stored amount of oxygen OSA of the upstream side exhaust purification catalyst 20 becomes the switching reference storage amount Cref, and when the stored amount of oxygen OSA of the upstream side exhaust purification catalyst 20 becomes the switching reference storage amount Cref or more the ECU 31 makes the target air-fuel ratio the rich air-fuel ratio continuously or intermittently until the air-fuel ratio of the exhaust gas detected by the downstream side air-fuel ratio sensor 41 becomes the rich judgment air-fuel ratio or less without the stored amount of oxygen OSA reaching the maximum storable oxygen amount Cmaxn.

More simply speaking, in the present embodiment, it can be said that the ECU 31 switches the target air-fuel ratio to the lean air-fuel ratio when the air-fuel ratio detected by the downstream side air-fuel ratio sensor 41 becomes the rich judgment air-fuel ratio or less and switches the target air-fuel ratio to the rich air-fuel ratio when the stored amount of oxygen OSA of the upstream side exhaust purification catalyst 20 becomes the switching reference storage amount Cref or more.

Further, in the above embodiment, the cumulative oxygen excess/deficiency ΣOED is calculated, based on the output air-fuel ratio AFup of the upstream air-fuel ratio sensor 40 and the estimated value of the air intake amount to the combustion chamber 6, etc. However, the stored amount of oxygen OSA may also be calculated based on parameters other than these parameters and may be estimated based on parameters which are different from these parameters.

<Problem 1 in Air-Fuel Ratio Control>

In this regard, in the above-mentioned air-fuel ratio control, the target air-fuel ratio is alternately switched between the rich set air-fuel ratio and the lean set air-fuel ratio. Further, the rich degree of the rich set air-fuel ratio (difference from stoichiometric air-fuel ratio) is kept relatively small. This is to keep as low as possible the concentration of unburned gas in the exhaust gas when rapid acceleration etc. of the vehicle which mounts the internal combustion engine cause the air-fuel ratio of the exhaust gas flowing into the upstream side exhaust purification catalyst 20 to be temporarily disturbed, or when the oxygen storage amount OSA of the upstream side exhaust purification catalyst 20 becomes substantially zero and thus rich air-fuel ratio exhaust gas flows out from the upstream side exhaust purification catalyst 20.

Similarly, the lean degree of the lean set air-fuel ratio (difference from stoichiometric air-fuel ratio) is also kept relatively small. This is to keep as low as possible the concentration of $NO_x$ in the exhaust gas when rapid deceleration etc. of the vehicle which mounts the internal combustion engine cause the air-fuel ratio of the exhaust gas flowing into the upstream side exhaust purification catalyst 20 to be temporarily disturbed or when some other factor causes the oxygen storage amount OSA of the upstream side exhaust purification catalyst 20 to reach the maximum storable oxygen amount Cmax and thus lean air-fuel ratio exhaust gas flows out from the upstream side exhaust purification catalyst 20.

On the other hand, the oxygen storage amount of the exhaust purification catalyst changes in accordance with the rich degree and the lean degree of the air-fuel ratio of the exhaust gas flowing into the exhaust purification catalyst. Specifically, a large rich degree and lean degree of the air-fuel ratio of the exhaust gas flowing into the exhaust purification catalyst enables the oxygen storage amount of the exhaust purification catalyst to be kept high. However, as explained above, the rich degree of the rich set air-fuel ratio and the lean degree of the lean set air-fuel ratio are kept relatively small from the viewpoint of the concentration of unburned gas or concentration of $NO_x$ in the exhaust gas flowing out from the upstream side exhaust purification catalyst 20. For this reason, if performing such control, it is not possible to maintain the oxygen storage amount of the upstream side exhaust purification catalyst 20 sufficiently high.

Here, the exhaust gas flowing into the upstream side exhaust purification catalyst. 20 becomes temporarily disturbed (outside disturbance) when the engine operating state is not the steady operating state. Conversely speaking, when the engine operating state becomes the steady operating state, outside disturbance is not liable to occur. For this reason, when the engine operating state is the steady operating state, even if increasing the rich degree of the rich set air-fuel ratio or the lean degree of the lean set air-fuel ratio, there is little possibility of $NO_x$ or unburned gas flowing out from the upstream side exhaust purification catalyst 20. Further, even if $NO_x$ or unburned gas flows out from the upstream side exhaust purification catalyst 20, the amount can be kept low. Note that, "when the engine operating state is the steady operating state" is when, for example, the amount of change per unit time of the engine load of the internal combustion engine is a predetermined amount of change or less, or when the amount of change per unit time of the intake air amount of the internal combustion engine is a predetermined amount of change or less.

<Rich Set Air-Fuel Ratio and Lean Set Air-Fuel Ratio Setting Control>

Therefore, in the present embodiment, when the engine operating state is the steady operating state, compared to when the engine operating state is not the steady operating state, the rich degree when setting the target air-fuel ratio the rich air-fuel ratio and the lean degree when setting the target air-fuel ratio the lean air-fuel ratio are set larger.

Figure 7:
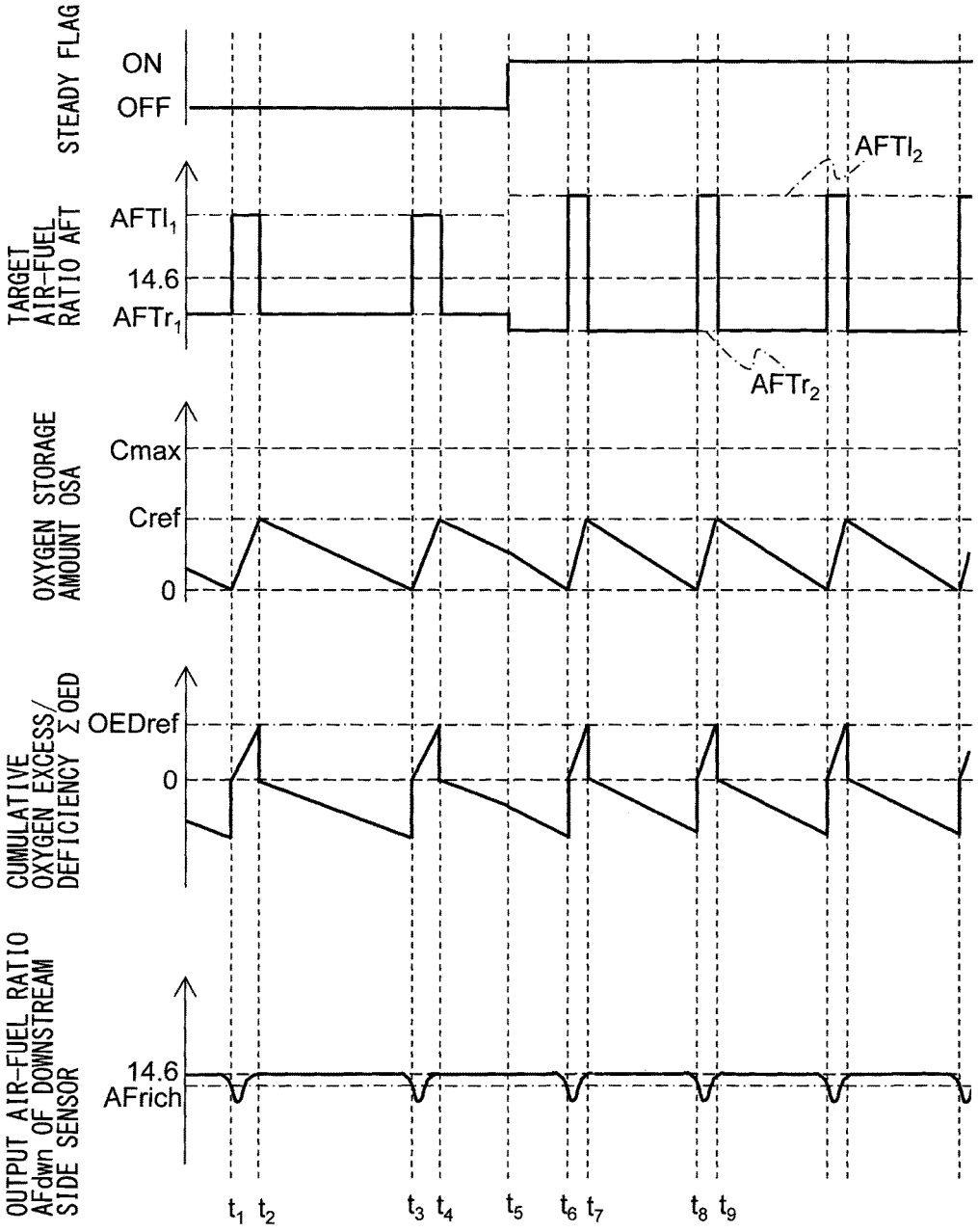
FIG. 7 is a time chart of a target air-fuel ratio etc. when performing target air-fuel ratio setting control.

FIG. 7 is a time chart, similar to FIG. 6, of a target air-fuel ratio etc. when performing the rich set air-fuel ratio and lean set air-fuel ratio setting control. In the example shown in FIG. 7, up to the time $t_5$, control similar to the case shown in FIG. 6 is performed. Therefore, when, at the times $t_1$ and $t_3$, the output air-fuel ratio AFdwn of the downstream side air-fuel ratio sensor 41 becomes the rich judgment air-fuel ratio AFrich or less, the target air-fuel ratio AFT is switched to a lean set air-fuel ratio AFT$\mathbf{1}_1$ which is slightly leaner than the stoichiometric air-fuel ratio (below, referred to as the "normal lean set air-fuel ratio"). On the other hand, when, at the times $t_2$ and $t_4$, the oxygen storage amount OSA of the upstream side exhaust purification catalyst 20 becomes the normal switching reference storage amount $Cref_1$ or more, specifically when the cumulative oxygen excess/deficiency becomes, the normal switching reference value $OEDref_1$ or more, the target air-fuel ratio AFT is switched to the rich set air-fuel ratio $AFTr_1$ (below, referred to as the "normal rich judgment air-fuel ratio"). Note that, up to the time $t_5$, the engine operating state is not the steady operating state. For this reason, a steady flag, which is set ON when the engine operating state becomes the steady operating state, is set OFF.

On the other hand, if, at the time $t_5$, the engine operating state becomes the steady operating state and, therefore, the steady flag is set to ON, the target air-fuel ratio AFT changed to an increased rich set air-fuel ratio $AFTr_2$, which is lower than the normal rich set air-fuel ratio $AFTr_1$ (larger in rich degree). Therefore, from the time $t_5$ on, the speed of decrease of the oxygen storage amount OSA of the upstream side exhaust purification catalyst 20 becomes faster.

After that, if, at the time $t_6$, the output air-fuel ratio AFdwn of the downstream side air-fuel ratio sensor 41 becomes the rich judgment air-fuel ratio AFrich or less, the target air-fuel ratio AFT is switched to the increased lean set air-fuel ratio AFT$\mathbf{1}_2$, which is higher than the normal lean set air-fuel ratio (larger in lean degree). Therefore, the increase speed of the oxygen storage amount OSA of the upstream side exhaust purification catalyst 20 at the time $t_6$ on becomes faster than the increase speed at the times $t_1$ to $t_2$, and $t_3$ to $t_4$.

When, at the time $t_7$, the oxygen storage amount OSA of the upstream side exhaust purification catalyst 20 becomes the switching reference storage amount Cref or more, specifically, when the cumulative oxygen excess/deficiency becomes the switching reference value OEDref or more, the target air-fuel ratio AFT is switched to the increased rich set air-fuel ratio $AFTr_2$. After that, so long as the engine operating state is the steady operating state, similar control is repeatedly performed. On the other hand, if, after that, the engine operating state is switched from the steady operating state to a transitory operating state (that is, an operating state not the steady operating state), the rich set air-fuel ratio is switched from the increased rich set air-fuel ratio $AFTr_2$ to the normal rich set air-fuel ratio $AFTr_1$. In addition, the lean set air-fuel ratio is also switched from the increased lean set air-fuel ratio AFT$\mathbf{1}_2$ to the normal lean set air-fuel ratio AFT$\mathbf{1}_1$.

According to the present embodiment, when the engine operating state is the steady operating state, the rich degree of the rich set air-fuel ratio and the lean degree of the lean set air-fuel ratio are set larger. For this reason, outflow of $NO_x$ or unburned gas from the upstream side exhaust purification catalyst 20 can be kept as small as possible while the oxygen storage amount of the upstream side exhaust purification catalyst 20 can be maintained higher.

Note that, in the above embodiment, when the engine operating state is the steady operating state, both the rich degree of the rich set air-fuel ratio and the lean degree of the lean set air-fuel ratio are set larger. However, it is not necessarily required that both of the rich degree and the lean degree be set larger. It is also possible to increase only one of the rich degree of the rich set air-fuel ratio and the lean degree of the lean air-fuel ratio. In this case, from the viewpoint of reducing as much as possible the $NO_x$ flowing out from the upstream side exhaust purification catalyst 20, it is preferable to not increase the lean degree of the lean air-fuel ratio and to increase only the rich degree of the rich set air-fuel ratio.

<Flow Chart>

Figure 8:
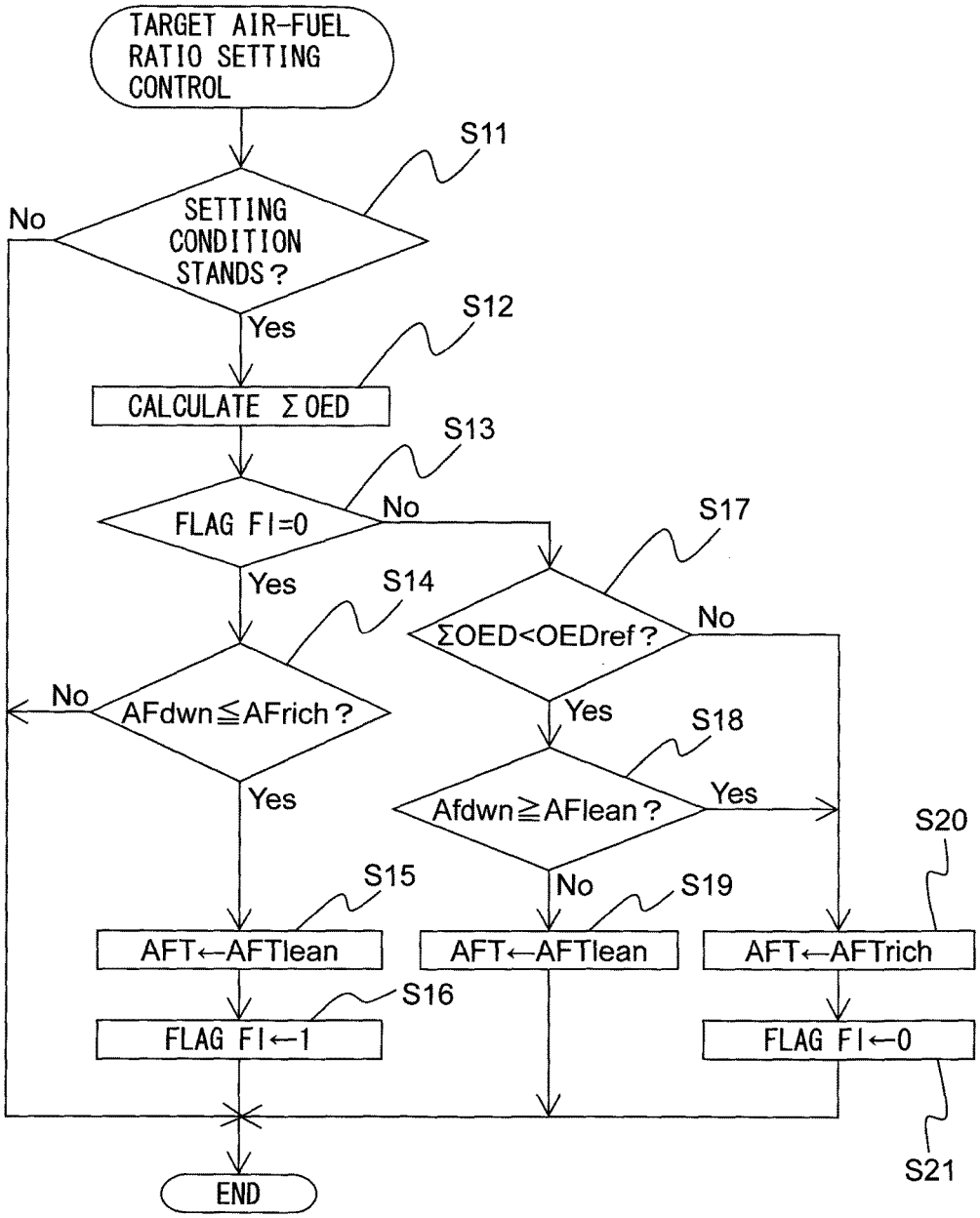
FIG. 8 is a flow chart which shows a control routine in target air-fuel ratio setting control.

FIG. 8 is a flow chart which shows a control routine in target air-fuel ratio setting control. The illustrated control routine is performed by interruption every certain time interval.

As shown in FIG. 8, first, at step S11, it is judged if the condition for setting the target air-fuel ratio AFT stands. As the case where the condition for setting the target air-fuel ratio AFT stands, the engine operation in ordinary control, for example, the engine operation not in the fuel cut control etc. may be mentioned. When it is judged at step S11 that the condition for setting the target air-fuel ratio stands, the routine proceeds to step S12. At step S12, the cumulative oxygen excess/deficiency ΣOED is calculated based on the output current Irup of the upstream side air-fuel ratio sensor 40 and the fuel injection quantity Qi.

Next, at step S13, it is judged if a lean setting flag Fl is set to 0. The lean setting flag Fl is a flag which is set to 1 when the target air-fuel ratio AFT is set to the lean set air-fuel ratio AFT1 and is set to 0 at other times. When it is judged at step S13 that the lean setting flag Fl is set to 0, the routine proceeds to step S14. At step S14, it is judged if the output air-fuel ratio AFdwn of the downstream side air-fuel ratio sensor 41 is the rich judgment air-fuel ratio AFrich or less. When it is judged that the output air-fuel ratio AFdwn of the downstream side air-fuel ratio sensor 41 is greater than the rich judgment air-fuel ratio AFrich, the control routine is ended.

On the other hand, if the oxygen storage amount OSA of the upstream side exhaust purification catalyst 20 is reduced and the air-fuel ratio of the exhaust gas flowing out from the upstream side exhaust purification catalyst 20 falls, at the next control routine, it is judged at step S14 that the output air-fuel ratio AFdwn of the downstream side air-fuel ratio sensor 41 is the rich judgment air-fuel ratio AFrich or less. In this case, the routine proceeds to step S15 where the target air-fuel ratio AFT is set to the lean set air-fuel ratio AFT1. Next, at step S16, the lean setting flag Fl is set to 1 and the control routine is ended.

At the next control routine, at step S13, it is judged that the lean setting flag Fl has not been set to 0 and the routine proceeds to step S17. At step S17, it is judged if the cumulative oxygen excess/deficiency ΣOED which was calculated at step S12 is smaller than the judgment reference value OEDref. When it is judged that the cumulative oxygen excess/deficiency ΣOED is smaller than the judgment reference value OEDref, the routine proceeds to step S18. At step S18, it is judged if the output air-fuel ratio AFdwn of the downstream side air-fuel ratio sensor 41 is the lean judgment air-fuel ratio AFlean or more, that is, if the oxygen storage amount OSA has reached the vicinity of the maximum storable oxygen amount Cmax. When, at step S18, it is judged that the output air-fuel ratio AFdwn is smaller than the lean judgment air-fuel ratio AFlean, the routine proceeds to step S19. At step S19, the target air-fuel ratio AFT continues to be set to the lean set air-fuel ratio AFT1.

On the other hand, if the oxygen storage amount of the upstream side exhaust purification catalyst 20 increases, finally, at step S17, it is judged that the cumulative oxygen excess/deficiency ΣOED is the judgment reference value OEDref or, more and the routine proceeds to step S20. Alternatively, when the oxygen storage amount OSA reaches the vicinity of the maximum storable oxygen amount Cmax, at step S18, it is judged that the output air-fuel ratio AFdwn of the downstream side air-fuel ratio sensor 41 is the lean judgment air-fuel ratio AFlean or more and the routine proceeds to step S20. At step S20, the target air-fuel ratio AFT is set to the rich set air-fuel ratio AFTr, then, at step S21, the lean setting flag Fl is reset to 0 and the control routine is ended.

Figure 9:
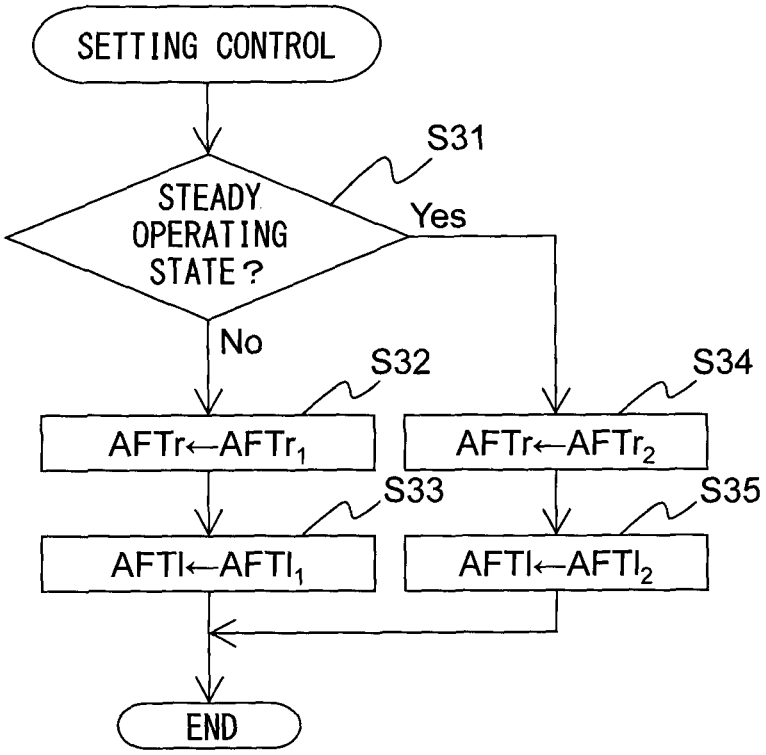
FIG. 9 is a flow chart which shows a control routine in the control for setting rich set air-fuel ratio and lean set air-fuel ratio.

FIG. 9 is a flow chart which shows a control routine in the control for setting the rich set air-fuel ratio and lean set air-fuel ratio. The illustrated control routine is performed by interruption every certain time interval.

First, at step S31, it is judged if the engine operating state is the steady operating state.

Specifically, for example, it is judged that the engine operating state is the steady operating state when the amount of change per unit time of the engine load of the internal combustion engine which is detected by the load sensor 43 is a predetermined amount of change or less, or when the amount of change per unit time of the intake air amount of the internal combustion engine which is detected by the air flowmeter 39 is a predetermined amount of change or less, and it is judged that the engine operating state is a transitory operating state (not steady operating state) at other times.

When it is judged at step S31 that the engine operating state is not the steady operating state, the routine proceeds to step S32. At step S32, the rich set air-fuel ratio AFTr is set to the normal rich set air-fuel ratio $AFTr_1$. Therefore, at step S20 of the flow chart which is shown in FIG. 8, the target air-fuel ratio is set to the normal rich set air-fuel ratio $AFTr_1$. Next, at step S33, the lean set air-fuel ratio AFT1 is set to the normal lean set air-fuel ratio $AFT1_1$. Therefore, at steps S15 and S19 of the flow chart which is shown in FIG. 8, the target air-fuel ratio is set to the normal lean set air-fuel ratio $AFT1_1$.

On the other hand, when, at step S31, it is judged that the engine operating state is the steady operating state, the routine proceeds to step S34. At step S34, the rich set air-fuel ratio AFTr is set to the increased rich set air-fuel ratio $AFTr_2$. Therefore, at step S20 of the flow chart which is shown in FIG. 8, the target air-fuel ratio is set to the increased rich set air-fuel ratio $AFTr_2$. Next, at step S35, the lean set air-fuel ratio AFT1 is set to the increased lean set air-fuel ratio $AFT1_2$. Therefore, at steps S15 and S19 of the flow chart which is shown in FIG. 8, the target air-fuel ratio is set to the increased lean set air-fuel ratio $AFT1_2$.

Second Embodiment

Next, referring to FIG. 10 and FIG. 14, a control system according to a second embodiment of the present invention will be explained. The configuration and control in the control system of the second embodiment are basically similar to the configuration and control of the control system of the first embodiment. However, in the second embodiment, not the rich set air-fuel ratio and lean set air-fuel ratio, but the switching reference storage amount is changed.

<Problem Point 2 in Air-Fuel Ratio Control>

In this regard, in the above-mentioned air-fuel ratio control, when the oxygen storage amount OSA of the upstream side exhaust purification catalyst 20 reaches the switching reference storage amount Cref, the target air-fuel ratio AFT is switched from the lean set air-fuel ratio AFT1 to the rich set air-fuel ratio AFTr. For this reason, at the upstream side part of the upstream side exhaust purification catalyst 20, oxygen is repeatedly stored and released, but at the downstream side part, almost no oxygen is stored and released. This will be explained with reference to FIG. 10.

FIG. 10 is a conceptual view which shows the stored state of oxygen at the upstream side exhaust purification catalyst 20. In the upstream side exhaust purification catalyst 20 in the figure, the hatched parts show the regions where oxygen is stored (that is, regions which are a lean atmosphere), while the non-hatched parts show the regions where oxygen is not stored (that is, regions which are a rich atmosphere).

Figure 10A:
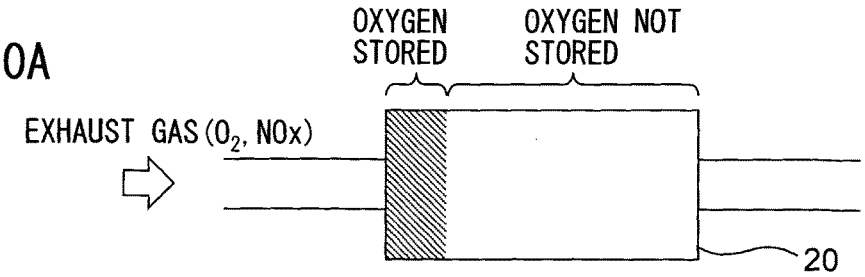
FIG. 10 is a conceptual view which shows a stored state of oxygen in an upstream side exhaust purification catalyst.
Figure 10B:
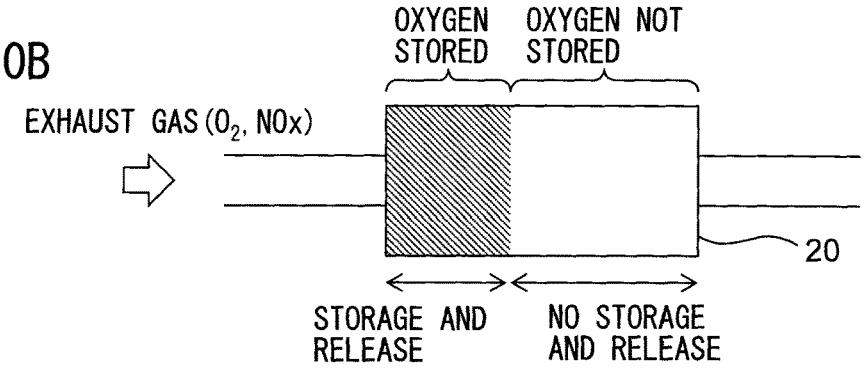

First, when the target air-fuel ratio AFT is set to the lean set air-fuel ratio AFT1, as shown in FIG. 10(A), the oxygen which is contained in the exhaust gas is stored in the upstream side exhaust purification catalyst 20. At this time, the oxygen in the exhaust gas is stored in order from the upstream side of the upstream side exhaust purification catalyst 20. FIG. 10(B) shows the state of the upstream side exhaust purification catalyst 20 when the oxygen storage amount OSA of the upstream side exhaust purification catalyst 20 becomes the switching reference storage amount Cref (in the illustrated example, about ⅓ of the maximum storable oxygen amount Cmax at the time of a new catalyst). At this time, as will be understood from FIG. 10(B), the upstream side exhaust purification catalyst 20 stores oxygen at only the upstream side part.

Figure 10C:
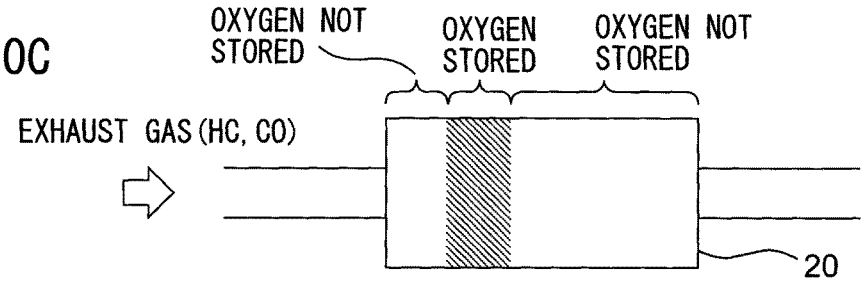
Figure 10D:
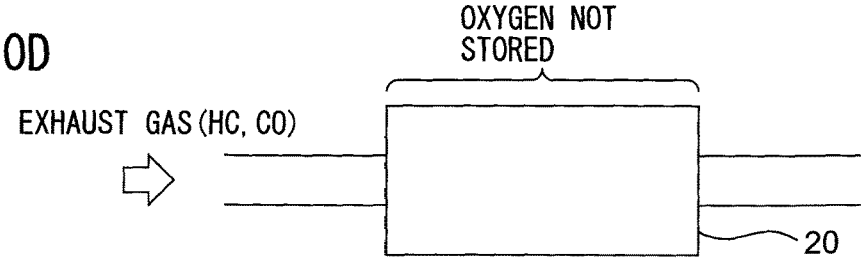

After that, if the target air-fuel ratio AFT is switched to the rich set air-fuel ratio AFTr, as shown in FIG. 10(C), to oxidize the unburned gas contained in the exhaust gas, the oxygen stored in the upstream side exhaust purification catalyst 20 is gradually released. At this time, the oxygen is released in order from the upstream side of the upstream side exhaust purification catalyst 20. After that, if a certain extent of time elapses after switching the target air-fuel ratio AFT to the rich set air-fuel ratio AFTr, as shown in FIG. 10(D), the oxygen storage amount OSA of the upstream side exhaust purification catalyst 20 becomes substantially zero and the target air-fuel ratio AFT is again switched to the lean set air-fuel ratio AFT1.

As will be understood from FIGS. 10(A) to 10(D), in the case of performing the above-mentioned air-fuel ratio control, basically oxygen is stored and released only at the upstream side part of the upstream side exhaust purification catalyst 20 (in FIG. 10(B), part shown by "absorption and release". Therefore, at the downstream side part of the upstream side exhaust purification catalyst 20 (in FIG. 10(B), part shown by "no absorption and release"), oxygen is not stored and released.

Here, as explained above, if the oxygen storage amount of the exhaust purification catalyst is maintained constant, the oxygen storage capacity of the exhaust purification catalyst will fall. In other words, the oxygen storage capacity of the exhaust purification catalyst is maintained by repeatedly storing and releasing oxygen. When performing the above-mentioned air-fuel ratio control, oxygen is repeatedly stored and released at the upstream side part of the upstream side exhaust purification catalyst 20, and therefore the oxygen storage capacity of the upstream side exhaust purification catalyst 20 is maintained high. However, almost no oxygen is stored and released at the downstream side part of the upstream side exhaust purification catalyst 20. For this reason, the oxygen storage capacity falls at the downstream side part of the upstream side exhaust purification catalyst 20 and as a result a fall in the purification performance of the upstream side exhaust purification catalyst 20 is invited.

Figure 10E:
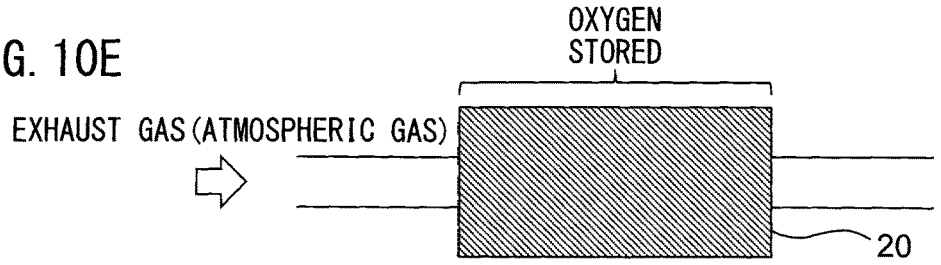

In this regard, in general, in an internal combustion engine mounted in a vehicle, fuel cut control which stops the feed of fuel to the combustion chambers 5 during operation of the internal combustion engine is performed at the time of vehicle deceleration. In such fuel cut control, fuel is not fed, and therefore atmospheric gas, that is, gas containing oxygen in a large amount, flows out from the combustion chambers 5. As a result, atmospheric gas is introduced into the upstream side exhaust purification catalyst 20 and, as shown in FIG. 10(E), the upstream side exhaust purification catalyst 20 as a whole stores oxygen. On the other hand, after the end of fuel cut control, the target air-fuel ratio AFT is set to the rich set air-fuel ratio AFTr (or an air-fuel ratio richer than that) until the output air-fuel ratio of the downstream side air-fuel ratio sensor 41 reaches the rich judgment air-fuel ratio AFrich. For this reason, as shown in FIG. 10(D), the oxygen storage amount OSA of the upstream side exhaust purification catalyst 20 becomes substantially zero.

Therefore, if fuel cut control is performed at certain intervals, oxygen is stored and released not only at the upstream side part of the upstream side exhaust purification catalyst 20, but also the downstream side part thereof. Accordingly, at the downstream side part of the upstream side exhaust purification catalyst 20 as well, the oxygen storage capacity can be maintained high. However, fuel cut control is performed in accordance with the operating state of the vehicle mounting the internal combustion engine, and therefore it is difficult to control the timing of execution of fuel cut control. For this reason, depending on the operating state of the vehicle, sometimes fuel cut control is not performed over a long period of time. In such a case, the above-mentioned air-fuel ratio control is performed continuously, and therefore a drop in the oxygen storage capacity is invited at the downstream side part of the upstream side exhaust purification catalyst 20.

<Control for Changing Switching Reference Storage Amount>

Therefore, in the present embodiment, to maintain the purification performance at the upstream side exhaust purification catalyst 20 during performance of the above-mentioned air-fuel ratio control, the switching reference storage amount Cref is increased over the amount up to then. However, the increased switching reference storage amount is also set to an amount smaller than the maximum storable oxygen amount Cmax at the time of a new catalyst.

In particular, in the present embodiment, from when the output air-fuel ratio of the downstream side air-fuel ratio sensor 41 last became the lean judgment air-fuel ratio AFlean or more due to fuel cut control etc. and then became smaller than the lean judgment air-fuel ratio AFlean, the cumulative value of the amount of flow of exhaust gas flowing into the upstream side exhaust purification catalyst 20 (below, referred to as "cumulative exhaust gas amount") is calculated. Further, if the thus calculated cumulative exhaust gas amount reaches a predetermined upper limit cumulative amount, the switching reference storage amount Cref is increased.

Note that, in the present embodiment, the amount of flow of exhaust gas flowing into the upstream side exhaust purification catalyst 20 is calculated based on the output of the air flowmeter 39. However, the amount of flow, of exhaust gas may also be calculated based on another parameter other than the output of the air flowmeter 39. Alternatively, the amount of flow detected by the air flowmeter 39 may also be used as the amount of flow of exhaust gas. Further, the cumulative amount of flow of exhaust gas to the upstream side exhaust purification catalyst 20 is calculated by cumulatively adding the thus calculated amount of flow of exhaust gas flowing into upstream side exhaust purification catalyst 20.

Figure 11:
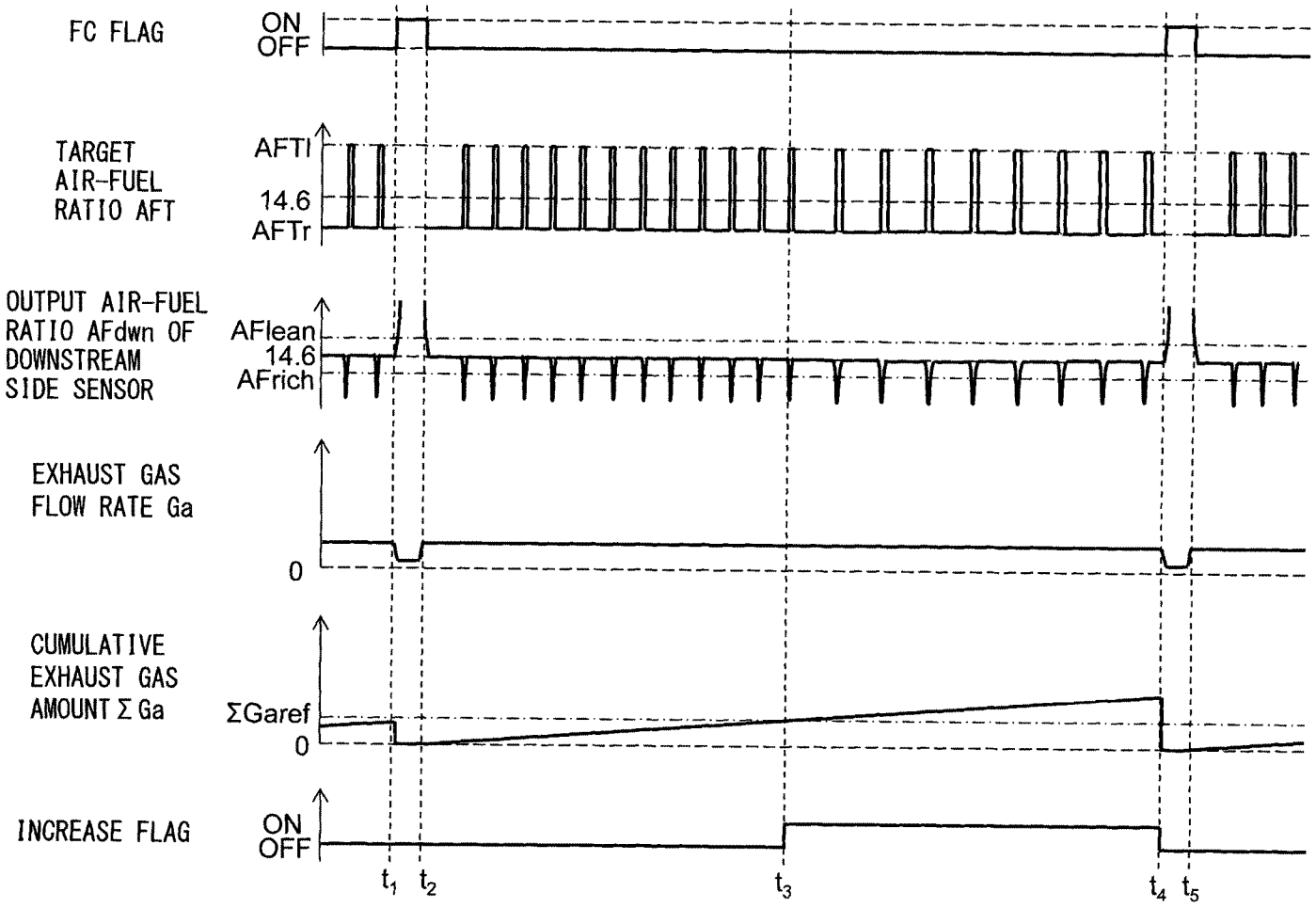
FIG. 11 is a time chart of a target air-fuel ratio etc. when performing control to change a switching reference storage amount.
Figure 12:
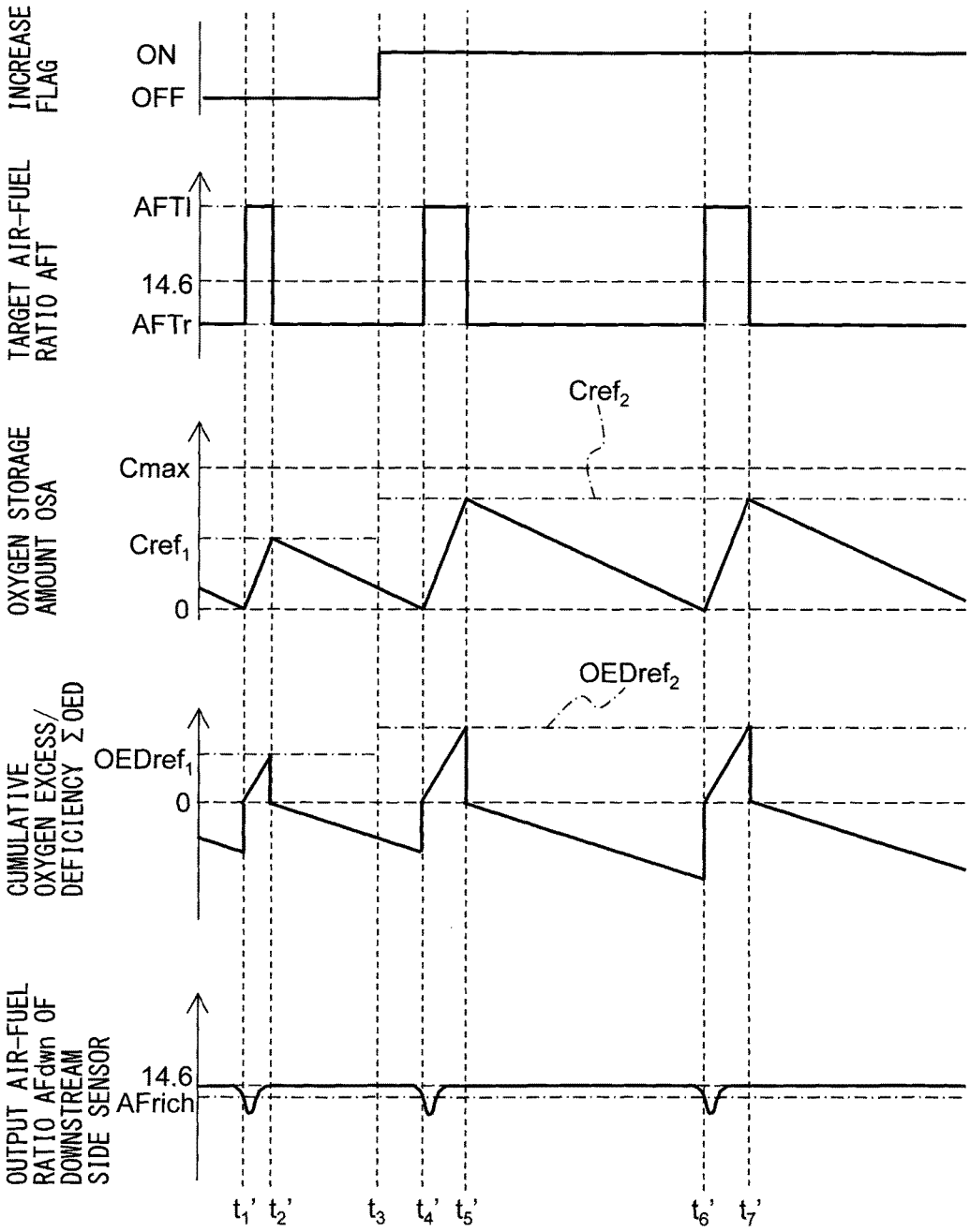
FIG. 12 is a time chart of a target air-fuel ratio etc. near the time $t_3$ of FIG. 11.

FIG. 11 is a time chart of a target air-fuel ratio etc. when performing control to change a switching reference storage amount. Further, FIG. 12 is a time chart of a target air-fuel ratio etc. near the time $t_3$ of FIG. 11. In the example shown in FIG. 11, when the FC flag is ON, fuel cut control is performed, while when the FC flag is OFF, the above-mentioned air-fuel ratio control is performed.

In the example shown in FIG. 11, before the time $t_1$, the above-mentioned air-fuel ratio control is performed. Therefore, control is performed so that when the output air-fuel ratio AFdwn of the downstream side air-fuel ratio sensor 41 becomes the rich judgment air-fuel ratio AFrich or less, the target air-fuel ratio AFT is switched to the lean air-fuel ratio while when the oxygen storage amount OSA of the upstream side exhaust purification catalyst 20 becomes the switching reference storage amount Cref or more, the target air-fuel ratio is switched to the rich air-fuel ratio.

Then, at the time $t_1$, if the vehicle which mounts the internal combustion engine decelerates etc., fuel cut control is started. If fuel cut control is started, feed of fuel to the combustion chambers 5 is stopped, and therefore the above-mentioned air-fuel ratio control is stopped. That is, the feedback control and the target air-fuel ratio setting control are stopped. Further, if fuel cut control is started, atmospheric gas flows out from the combustion chambers 5. For this reason, the oxygen storage amount OSA of the upstream side exhaust purification catalyst 20 immediately reaches the maximum storable oxygen amount Cmax. After that, atmospheric gas flows out from the upstream side exhaust purification catalyst 20 as well. As a result, immediately after the time $t_1$, the output air-fuel ratio AFdwn of the downstream side air-fuel ratio sensor 41 rapidly increases over the lean judgment air-fuel ratio AFlean. Note that, in the present embodiment, if the output air-fuel ratio AFdwn of the downstream side air-fuel ratio sensor 41 becomes the lean judgment air-fuel ratio AFlean or more, the cumulative exhaust gas amount ΣGa is reset to zero.

After that, in the example shown in FIG. 11, at the time $t_2$, fuel cut control is ended. If fuel cut control is ended, the above-mentioned air-fuel ratio control is resumed. In particular, at the point of the time $t_2$, the oxygen storage amount OSA of the upstream side exhaust purification catalyst 20 reaches the maximum storable oxygen amount Cmax, and therefore right after the end of fuel cut control, the target air-fuel ratio AFT is set to the rich set air-fuel ratio AFTr. After that, if the output air-fuel ratio AFdwn of the downstream side air-fuel ratio sensor 41 becomes the rich judgment air-fuel ratio AFrich or less, the target air-fuel ratio AFT is switched to the lean set air-fuel ratio AFT1. After that, it is alternately switched between the lean set air-fuel ratio AFT1 and the rich set air-fuel ratio AFTr.

In addition, if, at the time $t_2$, fuel cut control is ended and the output air-fuel ratio AFdwn of the downstream side air-fuel ratio sensor 41 becomes smaller than the lean judgment air-fuel ratio AFlean, the amount of flow of exhaust gas starts to be cumulatively added. Therefore, from the time $t_2$ on, if air-fuel ratio control is continuously performed without the output air-fuel ratio AFdwn becoming the lean judgment air-fuel ratio AFlean or more, the cumulative exhaust gas amount ΣGa will also gradually increase along with that.

In the example shown in FIG. 11, at the time $t_3$, the cumulative exhaust gas amount ΣGa reaches the reference cumulative exhaust gas amount ΣGaref. In the present embodiment, if the cumulative exhaust gas amount ΣGa becomes the reference cumulative exhaust gas amount ΣGaref or more, the increase flag is set to ON. If the increase flag becomes ON, the switching reference storage amount Cref is increased over the amount up to then. This state is shown in FIG. 12.

In the example shown in FIG. 12 as well, at the time $t_3$, the increase flag is set to ON. Therefore, before the time $t_3$, the air-fuel ratio control shown in FIG. 5 is performed. Accordingly, when, at the time $t_1'$, the output air-fuel ratio AFdwn of the downstream side air-fuel ratio sensor 41 becomes the rich judgment air-fuel ratio AFrich or less, the target air-fuel ratio AFT is switched to the lean set air-fuel ratio AFT1. After that, when, at the time $t_2'$, the oxygen storage amount OSA of the upstream side exhaust purification catalyst 20 becomes the switching reference storage amount $Cref_1$ (below, referred to as the "normal switching reference storage amount") or more, the target air-fuel ratio AFT is switched to the rich set air-fuel ratio AFTr.

If, at the time $t_3$, the increase flag becomes ON, the switching reference storage amount Cref is increased to a amount $Cref_2$ (below, referred to as the "increased switching reference storage amount") greater than the amount $Cref_1$ up to then. After that, when, at the time $t_4'$, the output air-fuel ratio AFdwn of the downstream side air-fuel ratio sensor 41 becomes the rich judgment air-fuel ratio AFrich or less, the target air-fuel ratio AFT is switched to the lean set air-fuel ratio AFT1. After that, until the oxygen storage amount OSA of the upstream side exhaust purification catalyst 20 reaches the increased switching reference storage amount at the time $t_5'$ $Cref_2$, the target air-fuel ratio AFT is maintained at the lean set air-fuel ratio AFT1.

If, at the time $t_5'$, the oxygen storage amount OSA of the upstream side exhaust purification catalyst 20 reaches the increased switching reference storage amount $Cref_2$, the target air-fuel ratio AFT is switched from the lean set air-fuel ratio AFT1 to the rich set air-fuel ratio AFTr. After that, until, the output air-fuel ratio AFdwn of the downstream side air-fuel ratio sensor 41 becomes the rich judgment air-fuel ratio AFrich or less at the time $t_6'$, the target air-fuel ratio AFT is maintained at the rich set air-fuel ratio AFTr. After that, the operation of the times $t_4'$ to $t_6'$ is repeated.

Returning to FIG. 11, if, at the time $t_3$ on, air-fuel ratio control is continued in the state where the switching reference storage amount is increased to the increased switching reference storage amount $Cref_2$, finally, fuel cut control is again started at the time $t_4$, due to deceleration of the vehicle, etc. If fuel cut control is started and the output air-fuel ratio AFdwn of the downstream side air-fuel ratio sensor 41 exceeds the lean judgment air-fuel ratio, air-fuel ratio control is stopped and, further, the increase flag is set to OFF. In addition, at this time, the cumulative exhaust gas amount ΣGa is reset to zero. For this reason, after that, even if fuel cut control ends, the switching reference storage amount is set to the normal switching reference storage amount $Cref_1$ until the cumulative exhaust gas amount ΣGa reaches the reference cumulative exhaust gas amount ΣGaref.

Figure 13A:
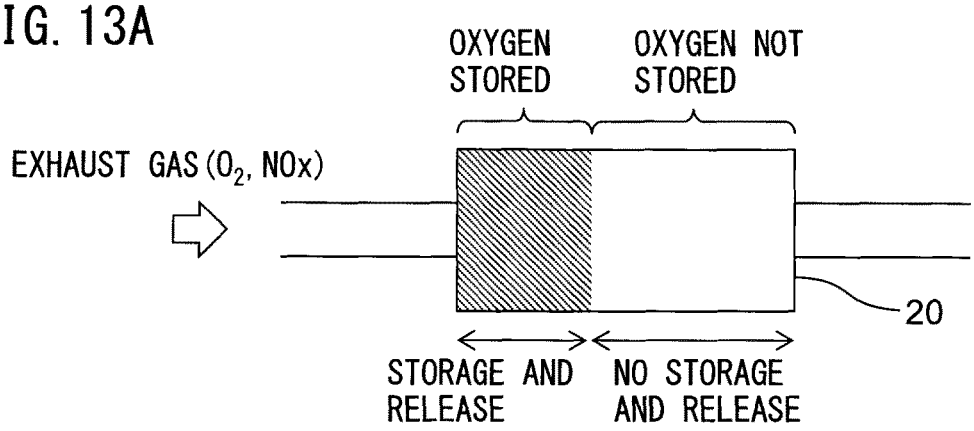
FIG. 13 is a conceptual view which shows a stored state of oxygen in an upstream side exhaust purification catalyst.
Figure 13B:
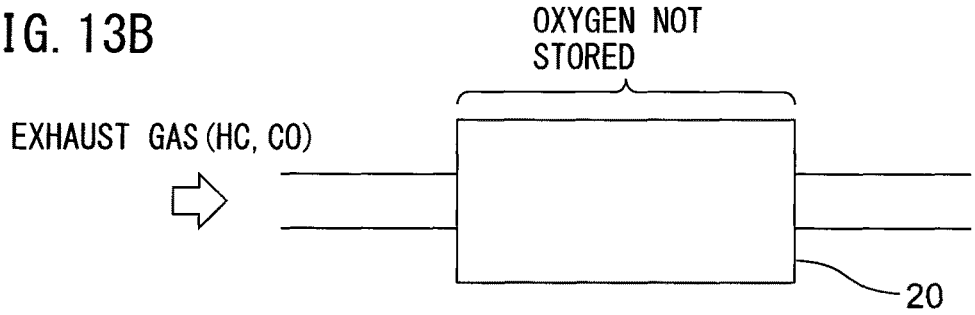

In the present embodiment, as explained above, if, in the interval between fuel cut control, the downstream side part of the upstream side exhaust purification catalyst 20 does not store and release oxygen for a long period of time, the switching reference storage amount is increased. Before making the switching reference storage amount increase from the normal switching reference storage amount $Cref_1$ to the increased switching reference storage amount $Cref_2$, in the upstream side exhaust purification catalyst 20, the state shown in FIG. 13(A) (state the same as FIG. 10(B)) and the state shown in FIG. 13(B) (state the same as shown in FIG. 10(D)) are alternately repeated. As opposed to this, after making the switching reference storage amount increase to the increased switching reference storage amount $Cref_2$, at the upstream side exhaust purification catalyst 20, the state shown in FIG. 13(C) and the state shown in FIG. 13(D) are alternately repeated. Therefore, after making the switching reference storage amount increase to the increased switching reference storage amount $Cref_2$, the region in which oxygen is stored and released in the upstream side exhaust purification catalyst 20 is increased. As a result, it is possible to keep the oxygen storage capacity from falling, that is, the purification performance from falling, at the downstream part of the upstream side exhaust purification catalyst 20, and maintain, the oxygen storage capacity high.

Note that, in the above embodiment, as an example of when the output air-fuel ratio AFdwn of the downstream side air-fuel ratio sensor 41 becomes the lean judgment air-fuel ratio AFlean or more, the case of performing fuel cut control is mentioned. However, even other than when performing fuel cut control, sometimes the output air-fuel ratio AFdwn of the downstream side air-fuel ratio sensor 41 becomes the lean judgment air-fuel ratio AFlean or more unintentionally, for example due to deterioration of the upstream side exhaust purification catalyst 20. In the present embodiment, even such a case is treated in the same way as when performing fuel cut control, and thus, for example, the cumulative exhaust gas amount is reset to zero.

Further, in the above embodiment, the amount of flow of exhaust gas starts to be cumulatively added from when the output air-fuel ratio of the downstream side air-fuel ratio sensor 41 becomes smaller than the lean judgment air-fuel ratio. However, the amount of flow of exhaust gas does not have to start to be cumulatively added at this time as long as started near when the output air-fuel ratio becomes smaller than the lean judgment air-fuel ratio. Therefore, the amount of flow of exhaust gas may start to be cumulatively added, for example, when fuel cut control ends, when the output air-fuel ratio of the downstream side air-fuel ratio sensor 41 converges from the lean air-fuel ratio to the stoichiometric air-fuel ratio, or when the output air-fuel ratio of the downstream side air-fuel ratio sensor 41 reaches the rich judgment air-fuel ratio for the first time after becoming the lean air-fuel ratio. Therefore, if summarizing these, the amount of flow of exhaust gas starts to be cumulatively added at a point of time in the period from when the finally performed fuel cut control ends to when the output air-fuel ratio AFdwn of the downstream side air-fuel ratio sensor 41 reaches the rich judgment air-fuel ratio AFrich. Alternatively, the amount of flow of exhaust gas starts to be cumulatively added at a point of time in the period from when the output air-fuel ratio AFdwn of the downstream side air-fuel ratio sensor 41 last changes from the lean judgment air-fuel ratio AFlean or more to less than that to when it reaches the rich judgment air-fuel ratio AFrich.

In addition, in the above embodiment, when the cumulative amount of flow of exhaust gas reaches a predetermined reference cumulative exhaust gas amount, the switching reference storage amount Cref is increased. However, the switching reference storage amount Cref may also be increased based on another parameter so long as it is a parameter which is related to the oxygen storage capacity at the downstream side part of the upstream side exhaust purification catalyst 20. For example, it is possible to make the switching reference storage amount Cref increase, when a predetermined reference time elapses from the above-mentioned point of time, or when the number of times of repetition of the cycle in the time $t_2$ to the time $t_5$ of FIG. 6 becomes a predetermined number of times.

Summarizing the above, in the present embodiment, it can be said that the switching reference storage amount Cref is increased over the amount up to then when a drop in purification performance of the upstream side exhaust purification catalyst 20 should be suppressed, that is, when a predetermined condition for increasing the switching reference quantity stands. Further, "when a drop in purification performance of the upstream side exhaust purification catalyst 20 should be suppressed, that is, when a predetermined condition for increasing the switching reference capacity stands", means when the cumulative amount of flow of exhaust gas becomes the reference cumulative exhaust gas amount or more from the above point of time, when the elapsed time becomes the reference time or more, or when the number of times of repetition of the cycle becomes a predetermined number of times. More inherently, in the present embodiment, it can be said that there is the feature that to suppress a drop in purification performance of the upstream side exhaust purification catalyst 20 during performance of air-fuel ratio control, the switching reference storage amount Cref is increased over the amount up to then.

Further, in the above embodiment, from the time $t_3$ of FIG. 11 and FIG. 12, on, the switching reference storage amount Cref is maintained at a constant increased switching reference capacity $Cref_2$. However, the increased switching reference storage amount Cref may also be set to gradually increase or otherwise change from the time $t_3$ on.

<Flow Chart>

Figure 14:
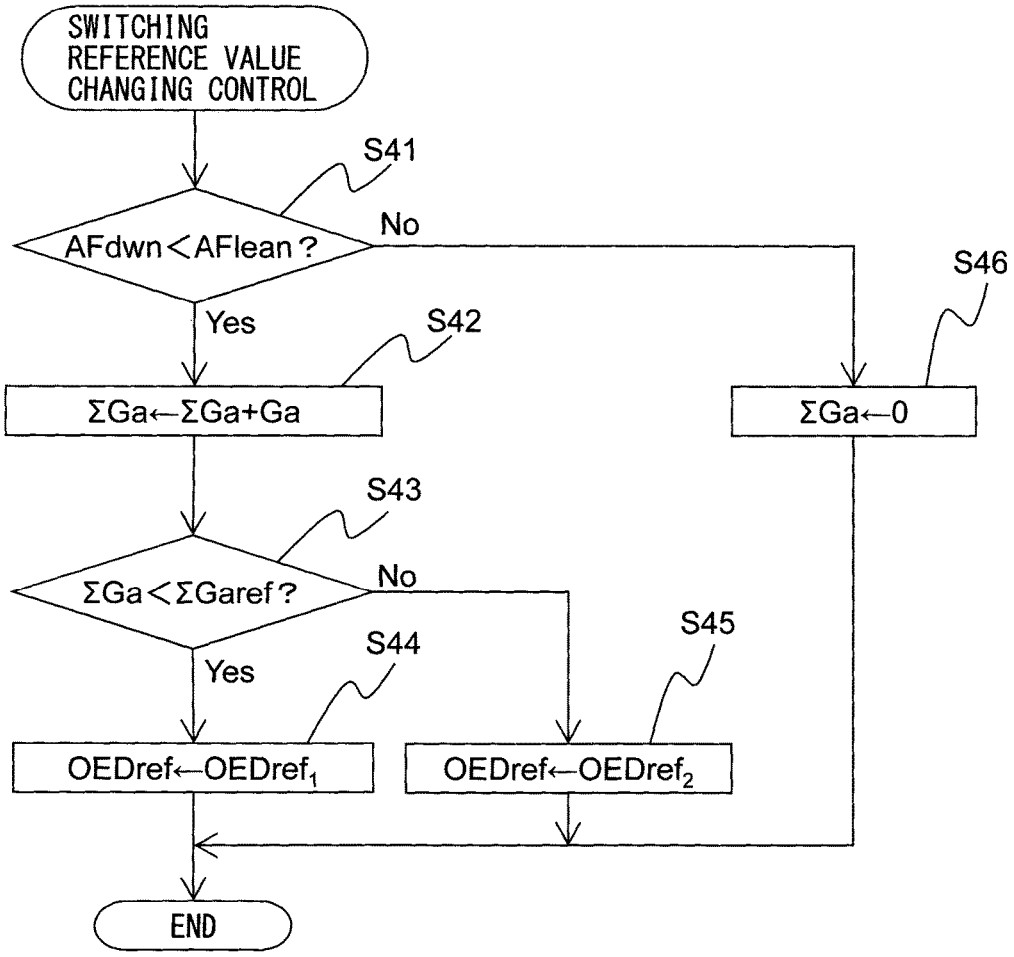
FIG. 14 is a flow chart which shows a control routine of control for changing a switching reference value.

FIG. 14 is a flow chart which shows a control routine of control for changing the switching reference value. The illustrated control routine is performed by interruption every certain time interval.

As shown in FIG. 14, first, at step S41, it is judged if the output air-fuel ratio AFdwn of the downstream side air-fuel ratio sensor 41 is smaller than the lean judgment air-fuel ratio AFlean. When it is judged at step S41 that the output air-fuel ratio AFdwn is smaller than the lean judgment air-fuel ratio AFlean, the routine proceeds to step S42. At step S42, the cumulative exhaust gas amount ΣGa is increased by the current amount of flow of exhaust gas Ga to obtain a new cumulative exhaust gas amount ΣGa.

Next, at step S43, it is judged if the cumulative exhaust gas amount ΣGa is smaller than the reference cumulative exhaust gas amount ΣGaref. When it is judged at step S43 that the cumulative exhaust gas amount ΣGa is smaller than the reference cumulative exhaust gas amount ΣGaref, the routine proceeds to step S44. At step S44, the increase flag is set to OFF, the switching reference value OEDref is set to normal switching reference value $OEDref_1$ (corresponding to normal switching reference storage amount $Cref_1$ in FIG. 12), and the control routine is ended. On the other hand, when it is judged at step S43 that the cumulative exhaust gas amount ΣGa is the reference cumulative exhaust gas amount ΣGaref or more, the routine proceeds to step S45. At step S45, the increase flag is set to ON, the switching reference value OEDref is set to the increased switching reference value $OEDref_2$ (corresponding to increased switching reference storage amount $Cref_2$ of FIG. 12) ($OEDref_2 > OEDref_1$), and the control routine is ended. On the other hand, when it is judged at step S41 that the output air-fuel ratio AFdwn of the downstream side air-fuel ratio sensor 41 is the lean judgment air-fuel ratio AFlean or more, the routine proceeds to step S46. At step S46, the cumulative exhaust gas amount ΣGa is reset to zero and the control routine is ended.

Third Embodiment

Next, referring to FIG. 15 and FIG. 16, a control system according to a third embodiment of the present invention will be explained. The configuration and control in the control system of the third embodiment are basically similar to the configuration and control of the control system of the second embodiment. However, in the third embodiment, the switching reference storage amount is changed based on the amount of flow of exhaust gas flowing into the upstream side exhaust purification catalyst 20.

Figure 13C:
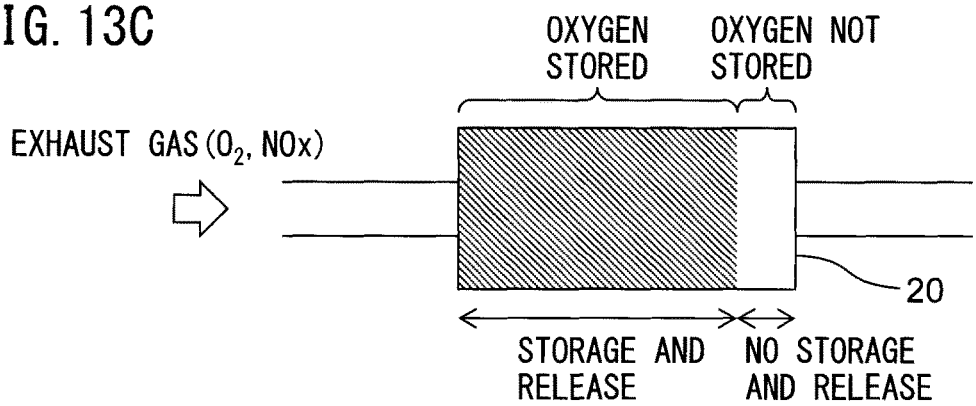
Figure 13D:
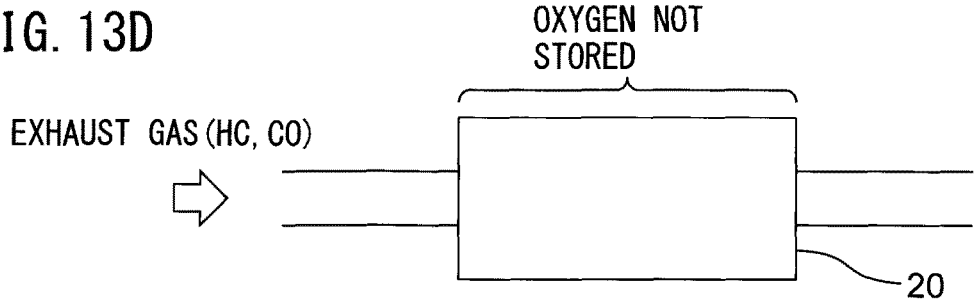

In this regard, as shown in FIG. 13(C), if making the switching reference storage amount Cref increase, that is, if making the switching reference value OEDref increase, the maximum value of the oxygen storage amount OSA of the upstream side exhaust purification catalyst 20 during air-fuel ratio control increases. For this reason, when there is error in calculation of the cumulative oxygen excess/deficiency ΣOED etc., the oxygen storage amount OSA of the upstream side exhaust purification catalyst 20 easily reaches the maximum storable oxygen amount Cmax. In particular, this tendency becomes stronger when the amount of flow of exhaust gas flowing into the upstream side exhaust purification catalyst 20 is large. In addition, if the oxygen storage amount of the upstream side exhaust purification catalyst 20 reaches the maximum storable oxygen amount Cmax, the greater the amount of flow of the exhaust gas flowing into the upstream side exhaust purification catalyst 20, the greater the amount of flow of the $NO_x$ flowing out from the upstream side exhaust purification catalyst 20.

Therefore, in the control system of the present embodiment, even when the cumulative exhaust gas amount ΣGa becomes the reference cumulative exhaust gas amount ΣGaref or more, when the amount of flow of exhaust gas flowing into the upstream side exhaust purification catalyst 20 is greater than the predetermined upper limit amount of flow, the switching reference storage amount Cref is not allowed to be increased.

Figure 15:
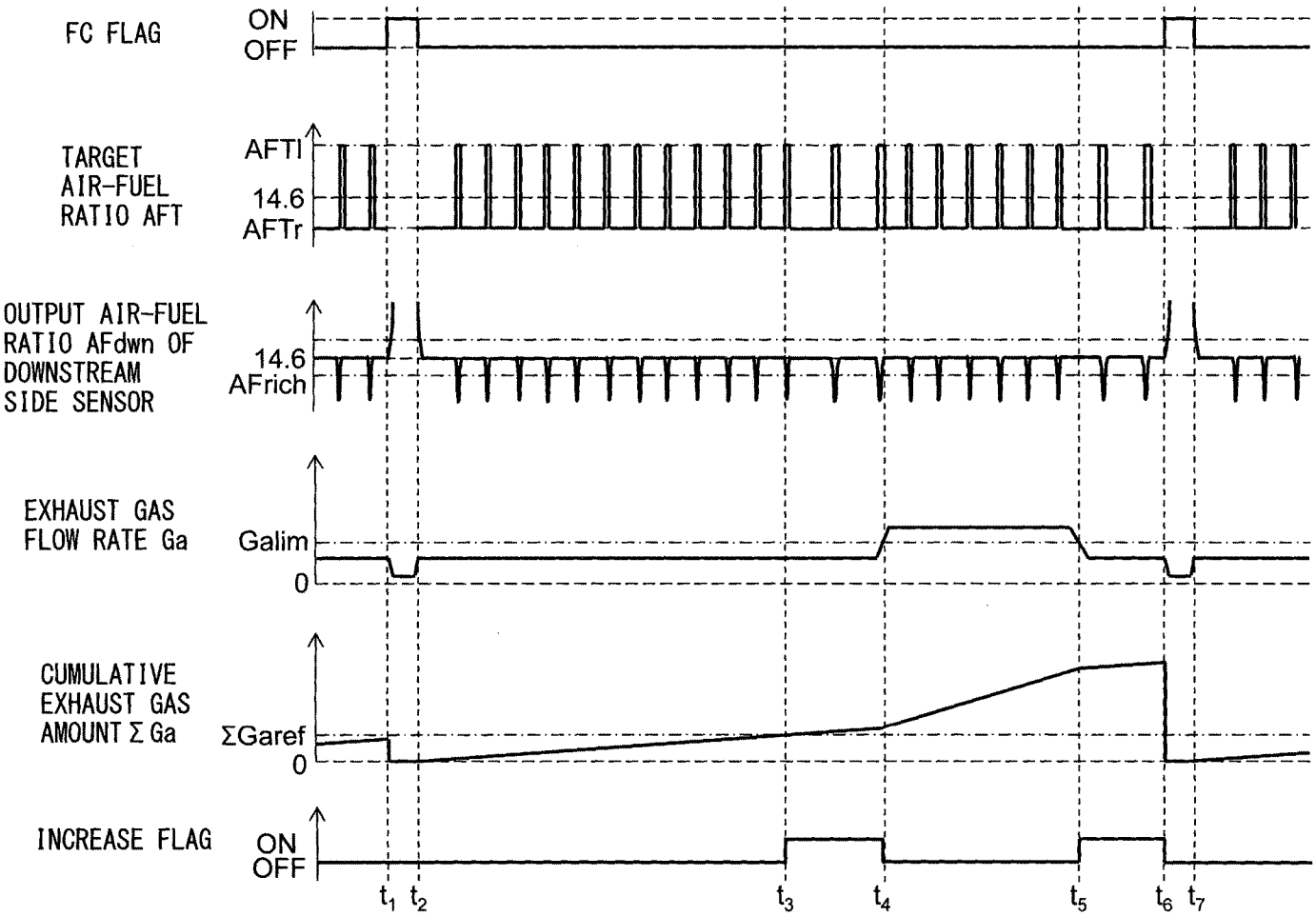
FIG. 15 is a time chart, similar to FIG. 11, of a target air-fuel ratio etc. when performing control to change a switching reference storage amount in a second embodiment.

FIG. 15 is a time chart, similar to FIG. 11, of a target air-fuel ratio etc. when performing control to change the switching reference storage amount. In the example shown in FIG. 15 as well, in the same way as the example shown in FIG. 11, when the FC flag becomes ON, fuel cut control is performed, while when the FC flag becomes OFF, the above-mentioned air-fuel ratio control is performed.

In the example shown in FIG. 15, up to the time $t_3$, control similar to the example shown in FIG. 11 is performed. Therefore, fuel cut control is started at the time $t_1$ and fuel cut control is ended at the time $t_2$. Further, if fuel cut control is ended and the output air-fuel ratio AFdwn of the downstream side air-fuel ratio sensor 41 becomes smaller than the lean judgment air-fuel ratio AFlean at the time $t_2$, the amount of flow of exhaust gas starts to be cumulatively added. After that, at the time $t_3$, the cumulative exhaust gas amount ΣGa reaches the reference exhaust gas amount ΣGaref and the increase flag is set to ON. For this reason, at the time $t_3$, the switching reference storage amount Cref is increased from the normal switching reference storage amount $Cref_1$ to the increased switching reference storage amount $Cref_2$. In particular, in the example shown in FIG. 15, at the time $t_3$, the amount of flow of exhaust gas Ga flowing into the upstream side exhaust purification catalyst 20 is the upper limit amount of flow Galim or less.

After that, in the example shown in FIG. 15, the amount of flow of exhaust gas Ga increases and, at the time $t_4$, reaches the upper limit amount of flow Galim. Therefore, in the present embodiment, at the time $t_4$, the increase flag is set to OFF. Along with this, the switching reference storage amount Cref is reduced from the increased switching reference storage amount $Cref_2$ to the normal switching reference storage amount $Cref_1$. After that, the increase flag is maintained in the OFF state while the amount of flow of exhaust gas Ga is an amount greater than the upper limit amount of flow Galim.

In the example shown in FIG. 15, after that, the amount of flow of exhaust gas Ga decreases and, at the time $t_5$, reaches the upper limit amount of flow Galim. Therefore, in the present embodiment, at the time $t_5$, the increase flag is set to ON and, along with this, the switching reference storage amount Cref is again increased from the normal switching reference storage amount $Cref_1$ to the increased switching reference storage amount $Cref_2$.

In the example shown in FIG. 15, after that, due to deceleration of the vehicle etc., at the time $t_6$, in the same way as the time $t_4$ of FIG. 11, fuel cut control is again started. If fuel cut control is started and the output air-fuel ratio AFdwn of the downstream side air-fuel ratio sensor 41 exceeds the lean judgment air-fuel ratio, air-fuel ratio control is stopped, and the increase flag is also set to OFF.

According to the present embodiment, when the cumulative exhaust gas amount ΣGa becomes the reference cumulative exhaust gas amount ΣGaref or more and the amount of flow of exhaust gas flowing into the upstream side exhaust purification catalyst 20 is greater than the upper limit amount of flow Galim, the switching reference storage amount Cref is increased. For this reason, it is possible to keep $NO_x$ from flowing out from the upstream side exhaust purification catalyst 20.

Figure 16:
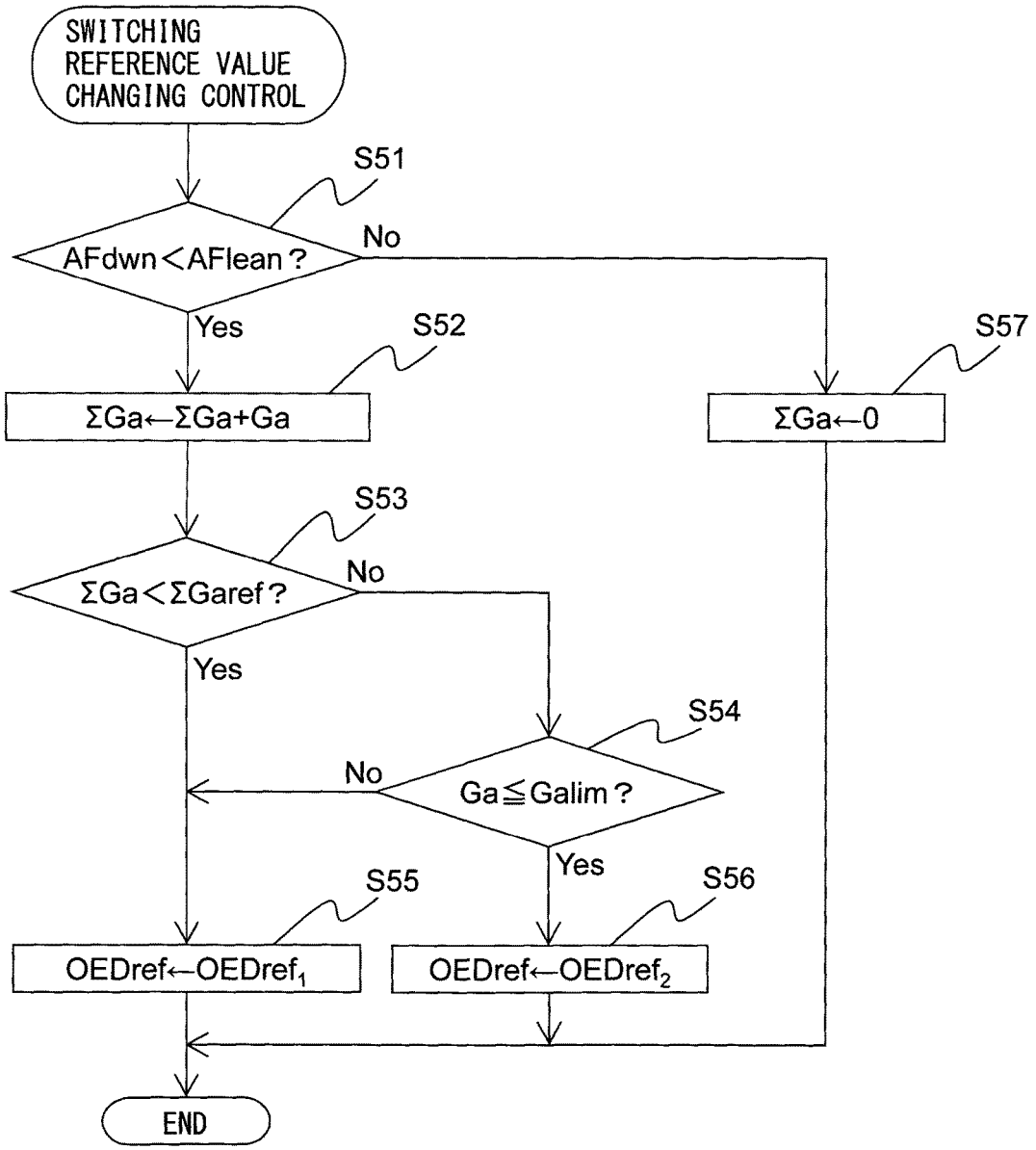
FIG. 16 is a flow chart which shows a control routine of control for changing a switching reference value in the second embodiment.

FIG. 16 is a flow chart which shows a control routine of control for changing the switching reference value in the present embodiment. The illustrated control routine is performed by interruption every predetermined time interval. Note that, steps S51 to S53 and S55 to S57 of FIG. 16 are respectively the same as steps S41 to S46 of FIG. 14, and therefore an explanation will be omitted.

When it is judged at step S53 that the cumulative exhaust gas amount ΣGa is the reference cumulative exhaust gas amount ΣGaref or more, the routine proceeds to step S54. At step S54, it is judged if the current amount of flow of exhaust gas Ga is a predetermined upper limit amount of flow Galim or less. When it is judged at step S54 that the current amount of flow of exhaust gas Ga is the upper limit amount of flow Galim or less, the routine proceeds to step S56 where the switching reference value OEDref is set to the increased switching reference value $OEDref_2$. On the other hand, when it is judged at step S54 that the current amount of flow of exhaust gas Gads greater than the upper limit amount of flow Galim, the routine proceeds to step S55 where the switching reference value OEDref is set to the normal switching reference value $OEDref_1$.

Note that, the control system of the first embodiment and the control system of the second embodiment or third embodiment may also be used in combination. For, example, if combining the control system of the first embodiment and the control system of the second embodiment, when the engine operating state is the steady operating state, compared to when it is not the steady operating state, at least one of the rich degree of the rich set air-fuel ratio or the lean degree of the lean set air-fuel ratio is increased, and when the condition for increasing the reference storage amount stands, the switching reference storage amount is increased from the amount up to then.

REFERENCE SIGNS LIST

1 engine body
5 combustion chamber
7 intake port
9 exhaust port
19 exhaust manifold
20 upstream side exhaust purification catalyst
24 downstream side exhaust purification catalyst
31 ECU
40 upstream side air-fuel ratio sensor,
41 downstream side air-fuel ratio sensor

The invention claimed is:

1. A control system of an internal combustion engine, the internal combustion engine including an exhaust purification catalyst which is arranged in an exhaust passage of the internal combustion engine and which can store oxygen, and a downstream side air-fuel ratio sensor which is arranged at a downstream side of said exhaust purification catalyst in an exhaust flow direction and which detects the air-fuel ratio of the exhaust gas flowing out from said exhaust purification catalyst, the control system comprising: an electronic control unit, and the electronic control unit performing feedback control so that an air-fuel ratio of the exhaust gas flowing into said exhaust purification catalyst becomes a target air-fuel ratio, and performing target air-fuel ratio setting control which switches said target air-fuel ratio to a lean set air-fuel ratio which is leaner than a stoichiometric air-fuel ratio when said air-fuel ratio detected by the downstream side air-fuel ratio sensor becomes equal to or less than a rich judgment air-fuel ratio and which switches said target air-fuel ratio to a rich set air-fuel ratio which is richer than the stoichiometric air-fuel ratio when an oxygen storage amount of said exhaust purification catalyst becomes equal to or greater than a predetermined switching reference storage amount smaller than the maximum storable oxygen amount, wherein when an engine operating state is a steady operating state, compared with when it is not a steady operating state, at least one of a rich degree of said rich set air-fuel ratio and a lean degree of said lean set air-fuel ratio is increased, and wherein during execution of said feedback control and said target air-fuel ratio setting control, when a condition for increasing the switching reference storage amount stands, said switching reference storage amount is increased.

2. The control system of an internal combustion engine according to claim 1, wherein the condition for increasing said switching reference storage amount stands when a cumulative exhaust gas amount which is cumulatively added from a point of time in a period from when the last performed fuel cut control ends to when the output air-fuel ratio of said downstream side air-fuel ratio sensor reaches said rich judgment air-fuel ratio, becomes a predetermined reference cumulative exhaust gas amount or more.

3. The control system of an internal combustion engine according to claim 1, wherein the condition for increasing said switching reference storage amount stands when an elapsed time from a point of time in a period from when the last performed fuel cut control ends to when the output air-fuel ratio of said downstream side air-fuel ratio sensor reaches the stoichiometric air-fuel ratio becomes a predetermined elapsed time or more.

4. The control system of an internal combustion engine according to claim 1, wherein the condition for increasing said switching reference storage amount stands when a cumulative exhaust gas amount which is cumulatively added from when the output air-fuel ratio of said downstream side air-fuel ratio sensor last reaches a lean judgment air-fuel ratio, which is leaner than the stoichiometric air-fuel ratio, or more, and then becomes smaller than said lean judgment air-fuel ratio, becomes a predetermined reference cumulative exhaust gas amount or more.

5. The control system of an internal combustion engine according to claim 1, wherein the condition for increasing said switching reference storage amount stands when a cumulative exhaust gas amount which is cumulatively added from when the last performed fuel cut control ends to when the output air-fuel ratio of said downstream side air-fuel ratio sensor reaches the stoichiometric air-fuel ratio is a predetermined reference cumulative exhaust gas amount or more and an amount of flow of exhaust gas flowing into said exhaust purification catalyst is an upper limit amount of flow or less.

6. The control system of an internal combustion engine according to claim 1, wherein the condition for increasing said switching reference storage amount stands when an elapsed time from a point of time in a period from when the last performed fuel cut control ends to when the output air-fuel ratio of said downstream side air-fuel ratio sensor reaches the stoichiometric air-fuel ratio is a predetermined elapsed time or more and an amount of flow of exhaust gas flowing into said exhaust purification catalyst is an upper limit amount of flow or less.

7. A control system of an internal combustion engine, the internal combustion engine including an exhaust purification catalyst which is arranged in an exhaust passage of the internal combustion engine and which can store oxygen, and a downstream side air-fuel ratio sensor which is arranged at a downstream side of said exhaust purification catalyst in an exhaust flow direction and which detects the air-fuel ratio of the exhaust gas flowing out from said exhaust purification catalyst, the control system comprising: an electronic control unit, and the electronic control unit performing feedback control so that an air-fuel ratio of the exhaust gas flowing into said exhaust purification catalyst becomes a target air-fuel ratio, and performing target air-fuel ratio setting control which switches said target air-fuel ratio to a lean set air-fuel ratio which is leaner than a stoichiometric air-fuel ratio when said air-fuel ratio detected by the downstream side air-fuel ratio sensor becomes equal to or less than a rich judgment air-fuel ratio and which switches said target air-fuel ratio to a rich set air-fuel ratio which is richer than the stoichiometric air-fuel ratio when an oxygen storage amount of said exhaust purification catalyst becomes equal to or greater than a predetermined switching reference storage amount smaller than the maximum storable oxygen amount, wherein during execution of said feedback control and said target air-fuel ratio setting control, when a condition for increasing the switching reference storage amount stands, said switching reference storage amount is increased.

8. The control system of an internal combustion engine according to claim 7, wherein the condition for increasing said switching reference storage amount stands when a cumulative exhaust gas amount which is cumulatively added from a point of time in a period from when the last performed fuel cut control ends to when the output air-fuel ratio of said downstream side air-fuel ratio sensor reaches said rich judgment air-fuel ratio, becomes a predetermined reference cumulative exhaust gas amount or more.

9. The control system of an internal combustion engine according to claim 7, wherein the condition for increasing said switching reference storage amount stands when an elapsed time from a point of time in a period from when the last performed fuel cut control ends to when the output air-fuel ratio of said downstream side air-fuel ratio sensor reaches the stoichiometric air-fuel ratio becomes a predetermined elapsed time or more.

10. The control system of an internal combustion engine according to claim 7, wherein the condition for increasing said switching reference storage amount stands when a cumulative exhaust gas amount which is cumulatively added from when the output air-fuel ratio of said downstream side air-fuel ratio sensor last reaches a lean judgment air-fuel ratio, which is leaner than the stoichiometric air-fuel ratio, or more, and then becomes smaller than said lean judgment air-fuel ratio, becomes a predetermined reference cumulative exhaust gas amount or more.

11. The control system of an internal combustion engine according to claim 7, wherein the condition for increasing said switching reference storage amount stands when a cumulative exhaust gas amount which is cumulatively added from when the last performed fuel cut control ends to when the output air-fuel ratio of said downstream side air-fuel ratio sensor reaches the stoichiometric air-fuel ratio is a predetermined reference cumulative exhaust gas amount or more and an amount of flow of exhaust gas flowing into said exhaust purification catalyst is an upper limit amount of flow or less.

12. The control system of an internal combustion engine according to claim 7, wherein the condition for increasing said switching reference storage amount stands when an elapsed time from a point of time in a period from when the last performed fuel cut control ends to when the output air-fuel ratio of said downstream side air-fuel ratio sensor reaches the stoichiometric air-fuel ratio is a predetermined elapsed time or more and an amount of flow of exhaust gas flowing into said exhaust purification catalyst is an upper limit amount of flow or less.

* * * * *